US007686528B2

(12) United States Patent
Gueret

(10) Patent No.: US 7,686,528 B2
(45) Date of Patent: Mar. 30, 2010

(54) DEVICE FOR PACKAGING AND APPLYING A SUBSTANCE

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 1200 days.

(21) Appl. No.: 11/100,374

(22) Filed: Apr. 7, 2005

(65) Prior Publication Data

US 2005/0232681 A1 Oct. 20, 2005

Related U.S. Application Data

(60) Provisional application No. 60/566,413, filed on Apr. 30, 2004.

(30) Foreign Application Priority Data

Apr. 9, 2004 (FR) ..... 04 50727

(51) Int. Cl.
*A46B 11/00* (2006.01)

(52) U.S. Cl. ..... 401/129; 401/4

(58) Field of Classification Search ..... 401/118, 401/121–129, 268, 269, 4
See application file for complete search history.

(56) References Cited

U.S. PATENT DOCUMENTS

| | | | | |
|---|---|---|---|---|
| 2,904,808 | A * | 9/1959 | Massman | 401/4 |
| 3,085,281 | A | 4/1963 | Massman | |
| 3,209,387 | A * | 10/1965 | Lukesch | 401/4 |
| 3,456,923 | A * | 7/1969 | Zeuzem | 366/243 |
| 5,192,153 | A | 3/1993 | Gueret | |
| 6,568,405 | B2 * | 5/2003 | Masuyama | 132/218 |
| 2002/0003983 | A1 | 1/2002 | Gueret | |
| 2002/0005209 | A1 | 1/2002 | Gueret | |
| 2002/0007839 | A1 | 1/2002 | Gueret | |
| 2003/0063945 | A1 | 4/2003 | Gueret | |

FOREIGN PATENT DOCUMENTS

| | | |
|---|---|---|
| DE | 31 00 529 A1 | 8/1982 |
| EP | 0 465 278 A1 | 1/1992 |
| EP | 1 177 741 A1 | 2/2002 |
| EP | 1 419 712 A1 | 5/2004 |
| FR | 1.374.719 A | 10/1964 |

* cited by examiner

*Primary Examiner*—Huyen Le
(74) *Attorney, Agent, or Firm*—Oliff & Berridge, PLC

(57) ABSTRACT

A device for packaging and applying a substance may include a receptacle for containing the substance and an applicator. The receptacle may include a first part and a second part, with the second part being turnable by a user relative to the first part. The second part may define at least one surface in contact with the substance inside the receptacle. The applicator and the surface may be arranged in such a manner that turning the surface exerts pressure on the substance, causing the substance to move toward the applicator. The first part may define a backing surface and the surface may be arranged to come at least in part to face the backing surface at an end of turning of the second part.

90 Claims, 22 Drawing Sheets

DEVICE FOR PACKAGING AND APPLYING A SUBSTANCE

CROSS-REFERENCE TO RELATED APPLICATIONS

This non-provisional application claims the benefit of French Application No. 04 50727 filed on Apr. 9, 2004 and U.S. Provisional Application No. 60/566,413 filed on Apr. 30, 2004, the entire disclosures of which are incorporated by reference herein.

BACKGROUND

The present invention relates to devices for packaging and applying a substance, such as a cosmetic or a care product.

German patent application DE 31 00529 A1 describes a device for packaging and dispensing a cream. The device comprises two portions that may turn relative to each other, and a chamber containing the cream. The chamber may be formed inside the device, with turning of one of the parts relative to the other causing the volume of said chamber to decrease and the cream to be dispensed directly via an outlet orifice. The device does not have an applicator device.

U.S. Pat. No. 3,085,281 discloses a receptacle for nail varnish including a bladed stirrer that may be rotated by the user using a knurled wheel at the bottom of the receptacle.

European patent application EP 1 177 741-A1 describes a receptacle including a stirrer that may be driven in rotation by the stem of the applicator.

French patent FR 1 374 719 describes a similar receptacle.

U.S. Patent Application Publication No. 2002/0007839 describes a packaging and applicator device having a piston engaged on a screw that may be turned by the user. Pressure exerted on the substance may be due to the piston moving axially. The piston must be prevented from turning relative to the body of the receptacle to be capable of being driven by the screw.

Packaging and applicator devices for mascara are also known that comprise an applicator comprising a brush mounted at the end of a stem with the other end of the stem being secured to a closure capsule for the receptacle, the capsule also constituting a handle. The receptacle may be generally elongate in shape and relatively narrow, so that the brush may extract most of the substance that may be contained in the receptacle. With such a device, a certain quantity of substance may be nevertheless never extracted by the brush and becomes lost after a chimney has been formed in the substance.

SUMMARY

There exists a need, for example: to modify the appearance of devices for packaging and applying a substance and including an applicator; to make such devices easy to carry about in a handbag; to create a new technique for loading the applicator with substance on each use; where appropriate, to make more uniform the substance contained in the device for extracting the applicator or for feeding to the applicator, which may be advantageous, for example, for substances comprising a plurality of immiscible phases, such as two or even three or more different phases; to modify the texture of the substance and/or the rheology of the substance, where appropriate, for example, for thixotropic substances; to facilitate loading of the applicator with a predefined quantity of substance on each use; to ensure that the substance may be of the same quality on each use; to enable the quantity of substance that may be loaded onto the applicator to be controlled, where appropriate; to enable at least one characteristic of the substance, such as, for example, color, covering power, brightness, staying power, and/or rheology, to be modified by adding one or more additional compounds in quantities selected by the user; to enable the substance to be heated, where appropriate, by being placed in a microwave oven, and consequently to make the temperature of the substance uniform in the event of a temperature gradient arising inside the receptacle; to increase the extractable fraction, for example, so as to reach an extractable fraction greater than or equal to 90%, or even 95%, or more; and to enable a mirror to be mounted thereon, where appropriate.

The invention seeks to satisfy at least one, or even all, of the above requirements.

Exemplary embodiments of the invention provide a device for packaging and applying a substance, the device comprising: a receptacle for containing the substance, the receptacle comprising: a first part and a second part, the second part being turnable by a user relative to the first part; and an applicator.

In exemplary embodiments, the applicator may be loaded with substance by turning the first and second parts relative to each other.

In exemplary embodiments, the second part may define at least one surface in contact with the substance inside the receptacle. The applicator and the surface may be arranged in such a manner that turning the surface causes pressure to be exerted on the substance, for example, by the surface, thereby causing the substance to move toward the applicator. Such movement of the substance may occur in various exemplary embodiments around and/or through the applicator, in one direction only or in several directions, for example, in two opposite directions in alternation. The surface may preferably be configured in such a manner that substantially all of the substance contained in the receptacle may be used. Advantageously, the substance may thus be caused to move toward the applicator until the receptacle has been emptied substantially completely.

In exemplary non-limiting embodiments, the device may include an anti-rotation system that allows the first part to turn relative to the second part in one direction only. Such an anti-rotation system may comprise, for example, at least one elastically-deformable tab carrying a pawl that moves in contact with a ratchet.

For example, the tab may be made with one of the first and second parts and the ratchet may be made one with the other one of the first and second parts.

In exemplary embodiments, the applicator may optionally be removable. In exemplary embodiments in which the applicator may be removable, the applicator may be secured to the receptacle when not in use, and may contribute to closing the receptacle.

In exemplary embodiments, the substance may be suitable for being made uniform, where appropriate, inside the receptacle by mixing caused by turning at least one surface in contact with the substance inside the receptacle, for example, defined by the second part.

In exemplary embodiments, the device may advantageously be used for packaging a substance of creamy, pasty, or gelled consistency, such as mascara, for example.

Exemplary embodiments of the invention enable the substance to be dispensed onto the applicator even when the device may be of a shape that may be wide rather than long. Exemplary embodiments of the invention thus make it possible to change the appearance of devices used for packaging and applying mascara, for example. For example exemplary embodiments of the invention may enable the overall bulk of the device to be reduced, thus facilitating transport.

In exemplary embodiments, a ratio of a height of the receptacle over a greatest transverse dimension of the receptacle may lie in a range of about 0.1 to about 10, for example, being close to 1, for example.

In exemplary embodiments, the substance may be contained in an inside space of the receptacle and a ratio of a height of the inside space over the greatest transverse dimension of the receptacle may lie in a range of about 0.1 to about 10, for example.

Exemplary embodiments of the invention enable a mirror to be secured to the device. This may be not true of conventional devices for packaging and applying mascara.

For example, the first and second parts may co-operate by snap-fastening so as to enable the first and second parts to turn relative to each other while preventing any relative displacement in an axial direction.

In exemplary embodiments, the first and second parts may be assembled together to form a junction that may be leak-tight. To this end, one of the first and second parts may include a sealing gasket or a sealing lip that co-operates with the other one of the first and second parts, for example.

In exemplary embodiments, the first part may define an inside space containing the substance. In other exemplary embodiments, the first and second parts may together define the inside space containing the substance. The first and second parts may, for example, define a size of the inside space.

In exemplary embodiments, the applicator may be situated in a center of the receptacle. In such embodiments, at least one surface in contact with the substance inside the receptacle, for example, defined by the second part, may be configured in such a manner that turning the surface moves the substance toward the center of the receptacle. For example, the surface may turn about the applicator when the applicator may be arranged for being refilled with substance by being inserted into the receptacle.

In exemplary embodiments, the surface that moves the substance toward the center of the receptacle on being turned need not be planar, and may be oriented in such a manner as to encourage flow toward the center of the receptacle.

Where appropriate, the surface may also be inclined upward or downward in such a manner as to produce also a flow of substance toward a top or a bottom of the receptacle.

In exemplary embodiments, the second part may co-operate with the first part to define at least two chambers inside the receptacle, with turning of the second part relative to the first part causing a volume of one of the chambers to vary in one direction and a volume of the other chamber to vary in an opposite direction. In such embodiments, the applicator may be dispensed substantially on a path of the substance flowing from one of the chambers toward the other one of the chambers.

In exemplary embodiments, the first and second parts may also define a chamber of variable volume. In such embodiments, turning the second part may cause the volume of the chamber to decrease, and may cause the substance to be dispensed toward the applicator.

In exemplary embodiments, the substance may be dispensed, for example, in a direction parallel to an axis of rotation of the second part. The substance may be dispensed toward the applicator, for example, when the applicator may be not housed inside the receptacle.

In other exemplary embodiments, the substance may be dispensed in some other direction, for example, a direction that may be not parallel to the axis of rotation, for example, in a direction that may be perpendicular to the axis of rotation.

In exemplary embodiments, the first part may include a bottom wall having a first portion in relief and a second portion in relief that co-operates with the first portion in relief so as to guide pivoting of the second part relative to the first part. The first portion in relief may comprise, for example, an indentation and the second portion in relief may comprise a stud engaged in the indentation, or vice versa.

In exemplary embodiments, the second part may include a blade. As used herein, the term "blade" should be understood broadly. The blade may be made integrally, i.e., monolithically, with the second part. In other exemplary embodiments, the blade may comprise at least one piece that may be fitted to the second part. The at least one piece may be made of a material that may be different from a material used for making a remainder of the second part, for example, a material that may be more rigid or more flexible, depending on a desired result. In embodiments in which the blade may be a separate fitting, the blade may be secured to a remainder of the second part by snap-fastening, for example.

In exemplary embodiments, the blade may be pierced by at least one opening, for example, a plurality of openings. This may reduce a force needed to cause the second part to turn relative to the first part, and, where appropriate, may reduce a force needed to mix the substance.

In exemplary embodiments, the second part may include an outer skirt that may be turned by a user.

In exemplary embodiments, the second part may also include a neck which may be threaded on an outside thereof so as to enable an internally-threaded closure cap to be secured thereto. Other means for fastening a closure cap on the neck may be used.

In exemplary embodiments, at least one surface in contact with the substance inside the receptacle, for example, defined by the second part, may extend to a wall of the first part that radially defines an outside of the inside space containing the substance. For example, this may enable a radially-outer edge of the second part to scrape substance off the wall, which may improve emptying of the receptacle. The surface may extend at least in part parallel to an axis of rotation of the second part. The surface may also extend at least in part in a radial plane containing the axis of rotation of the second part. The surface may extend about at least two radii, and the surface may be continuous. The surface may optionally intersect the axis of rotation. For example, the surface may be skew to a certain extent. For example, the surface may have a shape that may be adapted to improving a flow of substance over an entire height of the applicator. The surface may be configured specifically to cause the substance to rise, which would otherwise tend to accumulate at a bottom of the receptacle. The surface may thus be arranged to lift the substance as the surface turns, and may include a portion that slopes downward and in a travel direction of the surface.

The surface may also include a bottom edge that matches substantially a shape of a bottom wall of the receptacle, for example, so as to scrape off substance that has become deposited on the bottom wall. The surface may have a radially-inner edge that may be curved downward and inward, for example, so as to match substantially a shape of an applicator housed in the inside space. The surface may include a radially-outer edge substantially matching a shape of a side wall of the receptacle. The surface may include a radially-inner edge that substantially matches a profile of the applicator.

In exemplary embodiments, the device may include a handle member with a longitudinal axis substantially perpendicular to an axis of rotation of the second part. Where appropriate, the longitudinal axis of the handle member may coincide with that of the applicator.

In exemplary embodiments, the first part may define a backing surface and the surface defined by the second part may face the backing surface, at least in part, at an end of a turning stroke of the second part.

The backing surface may extend substantially radially toward a center of the receptacle. For example, the backing surface may be defined by a partition that projects into the inside space of the receptacle containing the substance.

In exemplary embodiments, the first part may include an outer covering.

In exemplary embodiments, the second part may be made as a single piece of plastics material. In other exemplary embodiments, the second part may comprise a plurality of component elements that are made separately and subsequently assembled together. For example, the second part may comprise an outer portion and an inner portion secured to the outer portion. The inner portion may be capable of turning relative to the first part without moving axially. For example, the inner portion may have an annular sealing lip that presses against the first part.

In exemplary embodiments, the first and second parts may be made out of different materials. This may reduce friction between the two parts and may facilitate turning one part relative to the other.

In exemplary embodiments, the device may include a dip tube.

In exemplary embodiments, the blade and/or the backing surface may extend at least in part along an axis that may be inclined relative to the axis of rotation so as to urge the substance toward the top or the bottom of the receptacle. Under such circumstances, the substance may be conveyed via a chimney toward the top, or may be held level with an inlet orifice of a dip tube in communication with a dispenser means.

In exemplary embodiments, the device may include a wiper member for wiping the applicator.

The wiper member may be molded together with the first and/or the second part, or may be fitted to one of the first and second parts, for example, fitted to the second part.

In embodiments in which the second part comprises an outer portion and an inner portion, one of the outer portion and the inner portion may carry the wiper member of the applicator. The wiper member may be made integrally, i.e., monolithically, with the inner portion, for example.

The wiper member may be made out of a material that may be different from that of the first and second parts and may be fitted to one of the first and second parts, or one of the first and second parts may be overmolded thereon.

The wiper member may be made of an injection-molded plastics material or out of a foam. Where appropriate or desired, the wiper member may be flocked. One of the first and second parts may include a perforated central chimney. The applicator may be received in the chimney.

For example, the applicator may be secured to a closure cap.

For example, the applicator may extend inside the receptacle when the closure cap may be in place thereon.

In exemplary embodiments, the applicator may include a stem that extends substantially parallel to the axis of rotation of the second part. In other exemplary embodiments, the applicator may include a stem that extends substantially perpendicularly to the axis of rotation of the second part, or with some other orientation. The stem may also be curved.

Where appropriate, the stem may include a narrow portion that comes into position in registration with the wiper member when in a storage position, thereby avoiding stressing the wiper member.

In exemplary embodiments, the applicator may be housed inside the receptacle in a space having the surface extending therearound.

In exemplary embodiments, the applicator may comprise a brush, for example, configured to apply substance to keratinous fibers, for example, the eyelashes and/or the eyebrows.

In exemplary embodiments, the applicator need not be a brush. For example, the applicator may comprise an endpiece made of elastomer or some other material, such as a felt or a foam, and may optionally be flocked. The applicator may include one or more cavities for filling with substance. The applicator may also comprise a ball, like a roll-on applicator, for example. The applicator may include a grid that may be flocked, at least in part.

In embodiments in which the applicator comprises a stem and an applicator element, the applicator element may have in cross-section a maximum dimension that may be, for example, less than, equal to, or greater than the diameter of the stem, depending on the nature of the applicator element.

In exemplary embodiments, the applicator does not extend into an inside space of the receptacle filled with substance. The device may include, for example, a permeable wall between the applicator and an inside space of the receptacle containing the substance.

In exemplary embodiments, the applicator may be secured to the second part at least when in use. The second part may include an internal duct arranged to feed substance to the applicator.

In exemplary embodiments, the device may include a closure cap. In such embodiments, the device may include a system that locks rotation of the closure cap relative to one of the first and second parts.

For example, the substance may be selected from: mascara, eye shadow, lipstick, eyeliner, a self-tanning substance, a care product, such as a lip care product, an anti-acne product, a spot concealer, a concealer of rings under the eyes, an after-sun product, a hair-care product, a dermatological product, a foundation, a deodorant and a care product for application around the eyes, this list not being limiting.

In exemplary embodiments, the substance may be solid or semi-solid at ambient temperature (20° C.).

For example, the substance may contain at least two phases that are immiscible, and may be made uniform by turning the first part relative to the second part.

In exemplary embodiments, the second part may include at least two blades.

In exemplary embodiments, the applicator may be off-center relative to the axis of rotation of the second part relative to the first. For example, the applicator may be swept through the substance when one of the parts turns relative to the other about the axis.

Independently or in combination with the above, exemplary embodiments of the invention may provide a device for packaging and applying a substance. The device may comprise: a receptacle for containing the substance, the receptacle comprising: a first part and a second part, the second part being turnable by a user relative to the first part; and an applicator suitable for placing inside the receptacle to be loaded with substance; the first part co-operating with the second part to define two chambers inside the receptacle, turning the second part relative to the first part causing a volume of one of the two chambers to vary in one direction and a volume of the other one of the two chambers to vary in an opposite direction, and vice versa, the applicator being placed on a path of the substance flowing from one of the two chambers toward the other one of the two chambers.

In exemplary embodiments, the extent to which the applicator may be loaded may be controlled, where necessary or desired, by acting on the amplitude or degree with which one of the parts may be turned relative to the other part.

Exemplary embodiments of the invention may also provide a device for packaging and applying a substance for application to at least one of skin, mucous membranes, nails and hair. The device may comprise: a receptacle for packaging the substance, the receptacle comprising a first part and a second part capable of turning relative to the first part about an axis of rotation; and an applicator suitable for being releasably secured to one of the first and second parts, in a manner that may be off-center relative to the axis of rotation, the applicator including an applicator element placed inside the receptacle in such a manner as to move in contact with the substance in the receptacle when the first and second parts turn relative to each other.

Exemplary embodiments of the invention may also provide a method of loading the applicator of a device as defined above with substance, in which the second part may be caused to turn relative to the first part through an angle that may be predefined as a function of the quantity of substance that it may be desired to deposit on the applicator.

Exemplary embodiments of the invention may also provide a kit comprising: a receptacle for containing the substance, the receptacle comprising: a first part and a second part, the second part being turnable by a user relative to the first part; an applicator, the second part defining at least one surface in contact with the substance inside the receptacle, the applicator and the surface being arranged in such a manner that turning the surface exerts pressure on the substance, causing the substance to move toward the applicator; and at least one additional compound for adding to the substance contained in the device.

For example, the additional compound may be one of a solvent, a coloring agent, a gloss agent, and a lubricating agent, for example, an oil.

Exemplary embodiments of the invention may also provide a method of making up in which the user inserts a desired quantity of at least one additional compound into the device as a function of the desired results, then makes the substance uniform by turning the first part relative to the second part.

BRIEF DESCRIPTION OF THE DRAWINGS

The invention may be better understood on reading the following detailed description of non-limiting examples thereof, and on examining the accompanying drawings, in which.

DETAILED DESCRIPTION OF EMBODIMENTS

Figure 1:
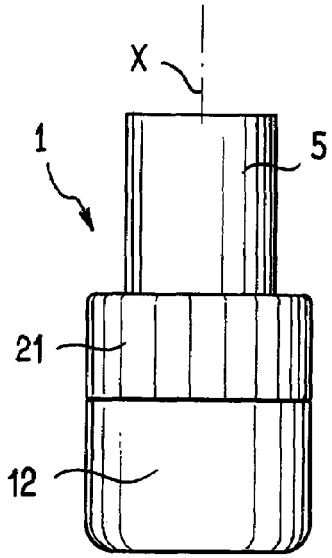
FIG. 1 may be a diagrammatic elevation view of an exemplary device.

FIG. 1 to 4 show a packaging and applicator device 1 made in accordance with an exemplary embodiment of the invention.

The device 1 may comprise a receptacle including a first part 10 and a second part 20 capable of turning relative to the first about an axis of rotation X, coinciding with the longitudinal axis of the device 1 in the exemplary embodiment of FIGS. 1-4.

The device 1 may further comprise an applicator 2, which itself may include an applicator element 3, comprising a brush in the example shown.

The applicator element 3 may be connected by a stem 4 to a handle member 5, which also may constitutes a closure cap for the receptacle.

In the exemplary embodiment of FIGS. 1-4, the stem 4 may extend along the axis of rotation X. However, the stem may be located elsewhere without thereby going beyond the ambit of the present invention.

The stem 4 may be made, for example, at least in part out of a plastics material, and may comprise at least one material such as: polyamide (PA); polyethylene (PE); polypropylene (PP); polystyrene (PS); acrylonitrile-butadiene-sytrene copolymer (ABS); sytrene acrylonitrile copolymer (SAN); polyacetyl (POM) or polyethylene terephthalate (PET); this list not being limiting.

In the exemplary embodiment of FIGS. 1-4, the first part 10 may comprise a pot 11, which may be engaged inside an outer covering 12, for example. The covering may extend over a fraction only of a height of the pot 11.

For example, the covering 12 may be retained on the pot 11 by friction, adhesive, heat-sealing, or snap-fastening. The covering may be made out of a metal, for example, while the pot 11 may be made out of a thermoplastic material.

The covering 12 may, where appropriate or desired, be made out of an elastomer material, for example, a thermoplastic elastomer, and may include projections on a surface thereof to make it easier for a user to hold.

In the exemplary embodiment of FIGS. 1-4, the pot 11 may include a top portion 13 in relief and an annular sealing lip 14.

Figure 4:
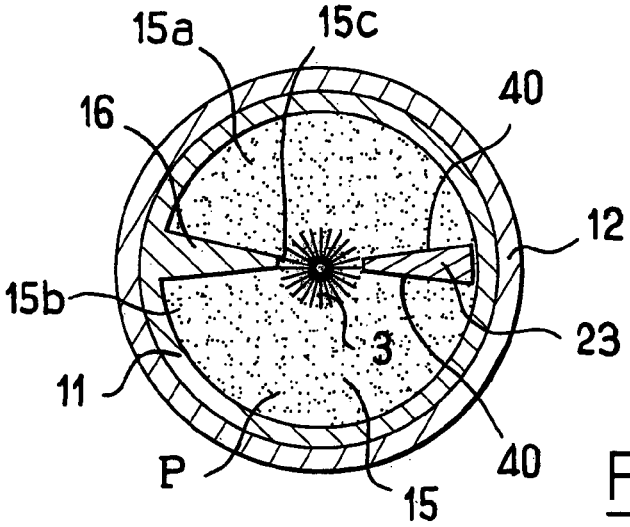
FIG. 4 may be a fragmentary and diagrammatic cross-section view taken along IV-IV of FIG. 3.

As shown in FIG. 4, the pot 11 may define an inside space 15 in which a substance P may be contained. The inside space 15 may correspond, for example, to the space occupied by the substance prior to first use. The level of substance may be then at a maximum inside the receptacle, reaching a height $h_i$ as measured from a bottom outside face of the receptacle.

The pot 11, which may be made out of at least one plastics material, such as PE, PP, PA, POM, PS, ABS, SAN, or PET, this list not being limiting, may include a partition 16 that extends radially toward a center of the inside space 15 to a vicinity of the applicator element 3, and that may be substantially complementary in shape thereto.

The second part 20 may include an outside skirt 21 arranged to snap-fasten on the portion 13 in relief and made integrally, i.e., monolithically, in the exemplary embodiment of FIGS. 1-4, with a threaded neck 22 suitable for securing the closure cap 5.

The portion 13 in relief may be made, for example, in the form of a continuous or discontinuous annular bead so as to hold the first part 10 axially relative to the second part, while allowing the first and second parts to turn relative to each other.

Figure 7:
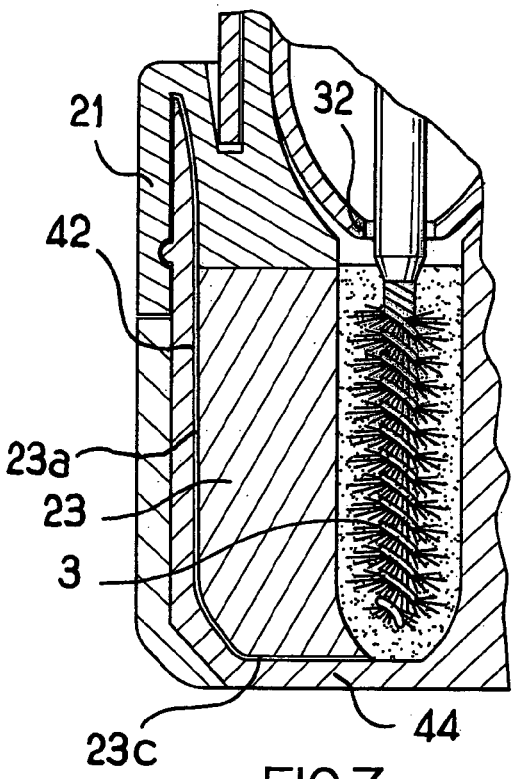
FIG. 7 may be a fragmentary axial section view of another exemplary device.

The second part 20 may include a blade 23 made integrally, i.e., monolithically, with the skirt 21 and the neck 22, in the exemplary embodiment of FIGS. 1-4. In the exemplary embodiment shown in FIG. 7, the blade 23 may be fitted to a remainder of the second part 20, thus facilitating making the blade 23 out of a different material, if so desired.

The blade 23 may preferably have a shape that matches a shape of both the applicator element 3 and the pot 11, respectively.

Figure 3:
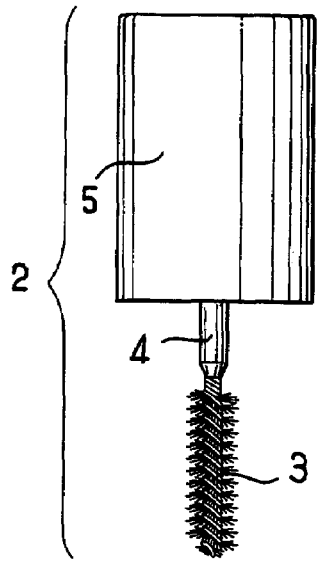
FIG. 3 may be a diagrammatic and fragmentary axial section view of the device of FIG. 1.
Figure 3:
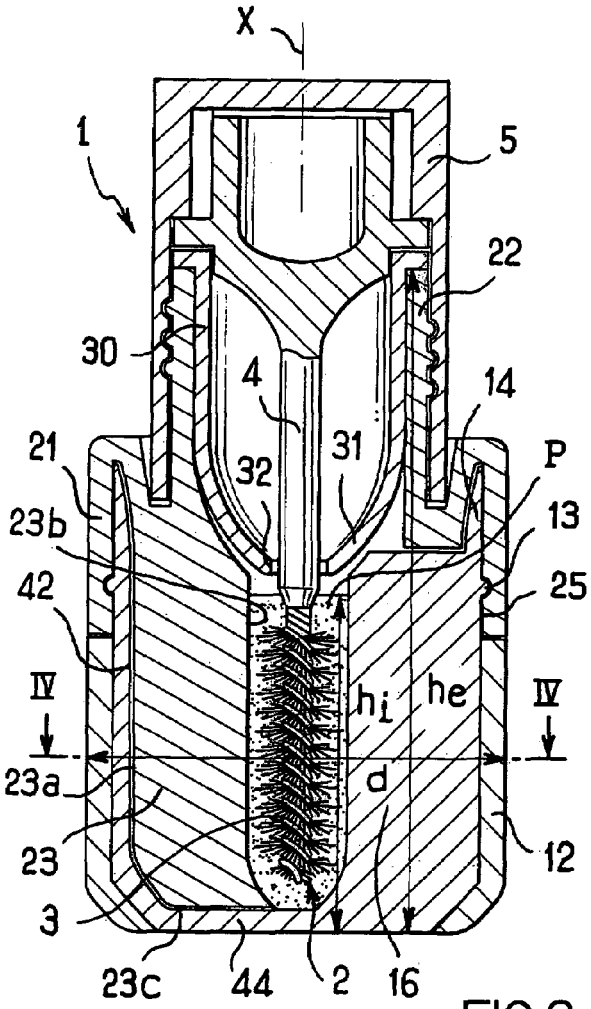
Figure 2:
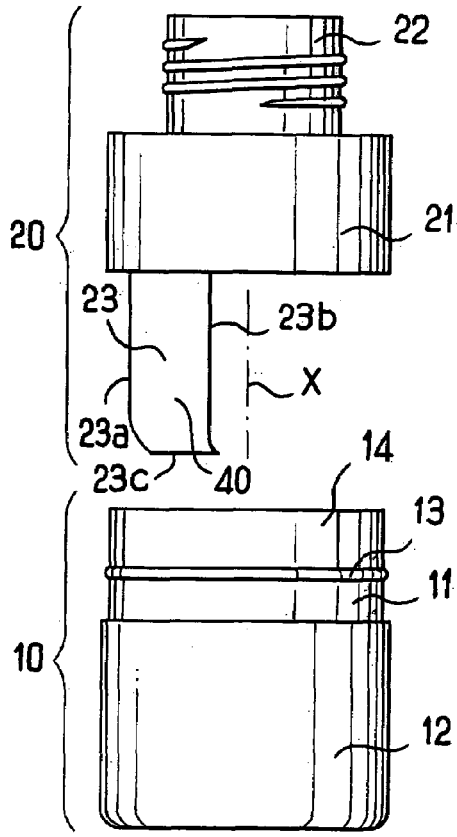
FIG. 2 may be an exploded view of the device of FIG. 1.

In the exemplary embodiment of FIG. 3, the blade 23 may include a radially outer edge **23*a* with a profile that enables the edge 23*a* to come close to a radially inside surface 42 of the pot 11**, for example, so as to scrape off the substance.

A radially inner edge **23*b* of the blade 23 may include a downwardly and inwardly curved bottom portion that substantially matches the shape of the applicator element 3**.

The bottom edge **23*c* of the blade 23 may substantially match the shape of the bottom wall 44** of the receptacle, for example, so as to scrape the substance that may be present thereon.

The second part 20 may be made out of at least one plastics material, for example, PE, PP, PA, POM, PS, ABS, SAN, or PET, this list not being limiting.

It may be advantageous to use different materials for making the first and second parts, for example, to reduce friction between them.

When the second part 20 may be in place on the first part 10, as shown in FIG. 3, the annular sealing lip 14 may press against the radially inside surface 25 of the skirt 21 so as to seal the assembly. Other sealing means are also contemplated.

As shown in FIG. 3, the device 1 may include a wiper member 30 suitable for being inserted in the neck 22 to wipe the applicator element 3 as it leaves the receptacle.

The wiper member 30 may be of any type, and, for example, may have a flexible lip 31 defining a circular orifice 32 at a bottom end thereof, a diameter of the orifice being substantially equal to a diameter of the stem 4. In other embodiments, the orifice 32 may have some other diameter and/or may be of a shape that may be not circular.

The wiper member 30 may be made of a plastics material, for example, PE, PP, POM, PET, nitrile, silicone, ethylene polypropylene diene (EPDM), sytrene-isoprene-sytrene (SMAY BE), or sytrene ethylene polypropylene butadiene-sytrene (SEBS), a thermoplastic polyester elastomer, such as that known under the trademark Hytrel®, for example, a thermoplastic elastomer, such as that known under the trade name Santoprene®, for example, this list not being limiting.

The wiper member 30 need not be fitted in the neck, but may be molded therewith, or the neck may be overmolded thereon.

Figure 5:
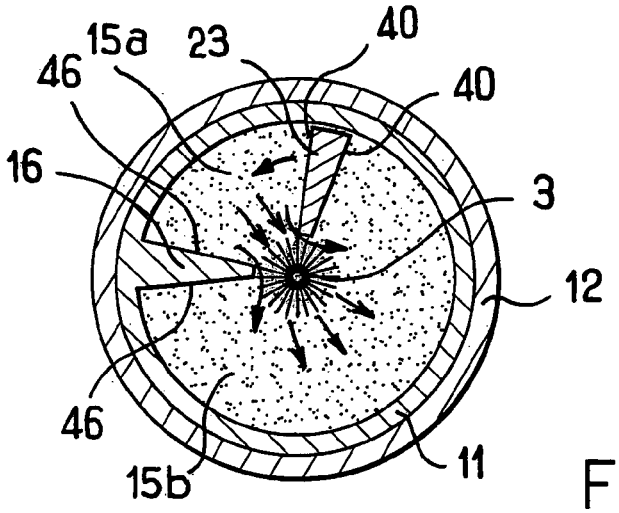
FIGS. 5 and 6 are views analogous to FIG. 4 after the second part has been turned relative to the first.
Figure 6:
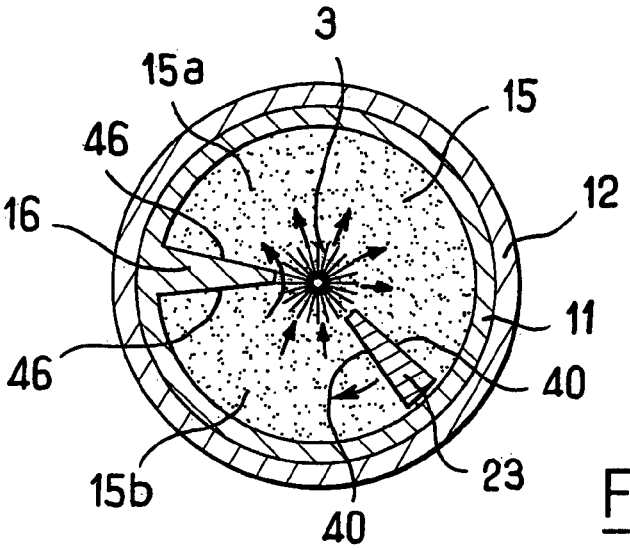

As shown in FIGS. 4 to 6, the blade 23 and the partition 16 together may define two chambers 15*a* and 15*b* inside the space 15. The chambers 15*a* and 15*b* may communicate with each other via a central region 15*c* in which the applicator element 3 may be situated when the applicator 3 may be in place on the receptacle.

Each main face of the blade 23 may define a rotary surface 40, one of which may exert thrust on the substance, depending on the direction in which the second part 20 may be turned.

The partition 16 may define backing surfaces 46. At an end of turning of the second part 20 relative to the first part 10, one of the rotary surfaces 40 may come substantially to overlie one of the backing surfaces 46.

When the user turns the second part 20 relative to the first part 10 in either direction, movement of the blade 23 inside the space 15 may cause a volume of one of the chambers 15*a* or 15*b* to decrease while causing a volume of the other of the chambers to increase, thereby causing the substance to flow from one chamber toward the other chamber through the central region 15*c*, thus enabling the applicator element 3 to be filled with substance.

In the exemplary embodiment of FIG. 5, the volume of the chamber 15*a* may be decreasing while the volume of the chamber 15*b* may be increasing, so the substance flows from the chamber 15*a* into the chamber 15*b*. FIG. 6 shows the contrary situation.

When the second part 20 may be turned relative to the first part 10, for example, with the user holding the covering 12 in one hand and turning the outer skirt 21 with the other hand, movement of the blade 23 in the inside space 15 may cause the substance P to be stirred to some extent, which may contribute to making the substance P uniform.

In the exemplary embodiment of FIG. 3, the ratio $h_e/d$ of a height $h_e$ of the receptacle formed by the first and second parts when assembled together divided by a greatest transverse dimension $\underline{d}$ of the receptacle may lie in a range of about 0.1 to about 10, for example, in a range of about 0.1 to about 2. For example, it may be possible for $d>h_e/2$, which may give the device a relatively stocky outline, very different from the highly elongate appearance of conventional prior art devices for packaging and applying mascara.

The ratio $h_i/d$ of the height $h_i$ of the inside space 15 of the receptacle over the greatest transverse dimension $\underline{d}$ of the receptacle may lie in a range of about 0.1 to about 10, for example. For example, it may be possible for $d>h_i$.

Figure 8:
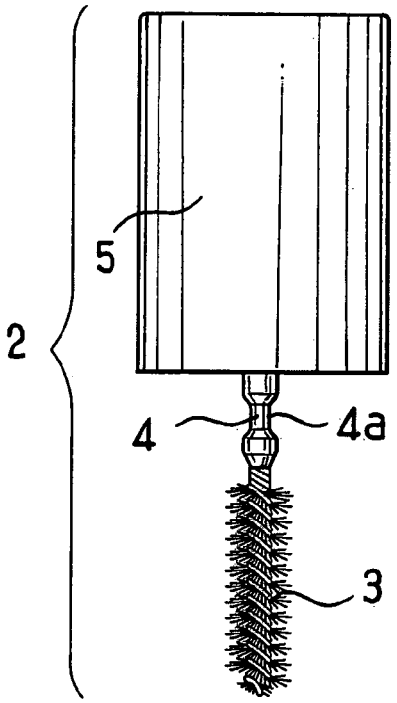
FIGS. 8 and 9 are diagrammatic elevation views of various exemplary embodiments of the applicator.
Figure 9:
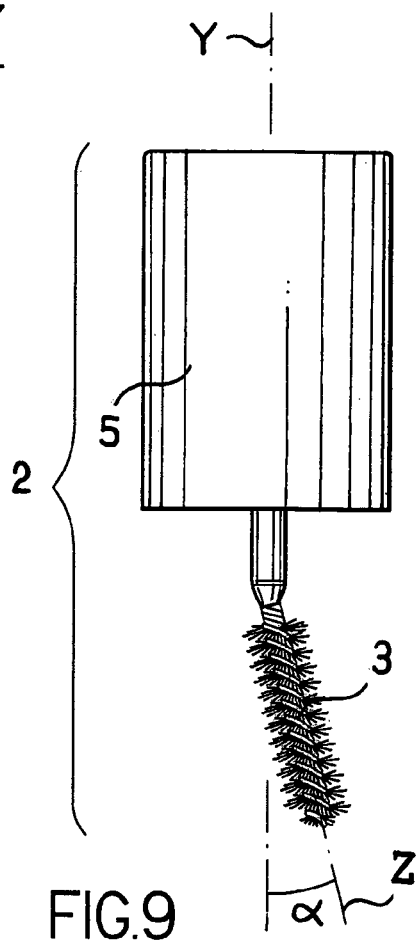

The stem 4 of the applicator may be made with a narrow portion 4*a* as shown in FIG. 8. The narrow portion 4*a* may take up a position in registration with the orifice 32 in the wiper member, a diameter of the orifice 32 may then preferably be substantially equal to a diameter of the stem 4 other than in the narrow portion 4*a* thereof. The narrow portion 4*a* may reduce stresses exerted by the stem 4 on the wiper member when the applicator may be in position on the receptacle. Where appropriate or desired, as shown in FIG. 9, the applicator element 3 may extend along a longitudinal axis Z that makes a non-zero angle $\alpha$ with the longitudinal axis Y of the applicator.

In the exemplary embodiment of FIG. 1, the inside space containing the substance may be defined laterally solely by the pot 11.

Figure 10:
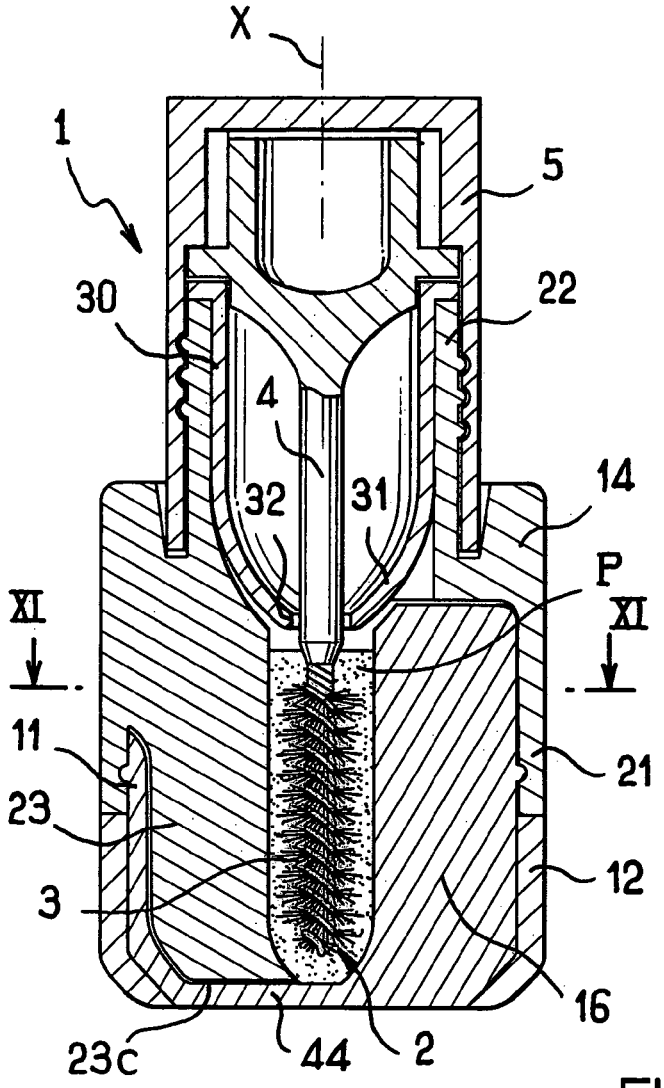
FIG. 10 may be an axial section view of another exemplary embodiment of a device.
Figure 11:
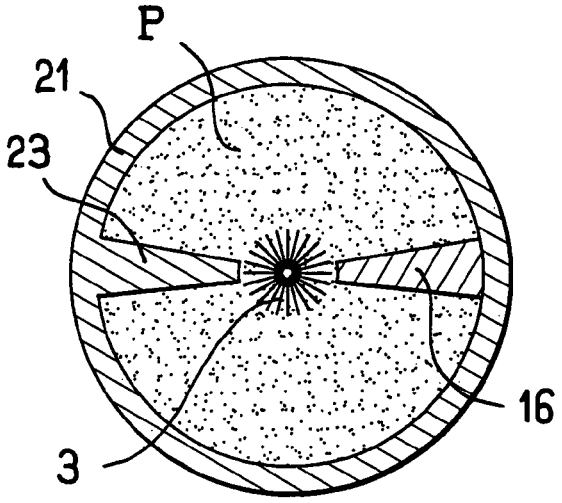
FIG. 11 may be a cross-section view taken along XI-XI of FIG. 10.

In the exemplary embodiment shown in FIGS. 10 and 11, the inside space containing the substance may be defined laterally toward the bottom by the pot 11 and toward the top by the outer skirt 21 of the second part 20.

Figure 12:
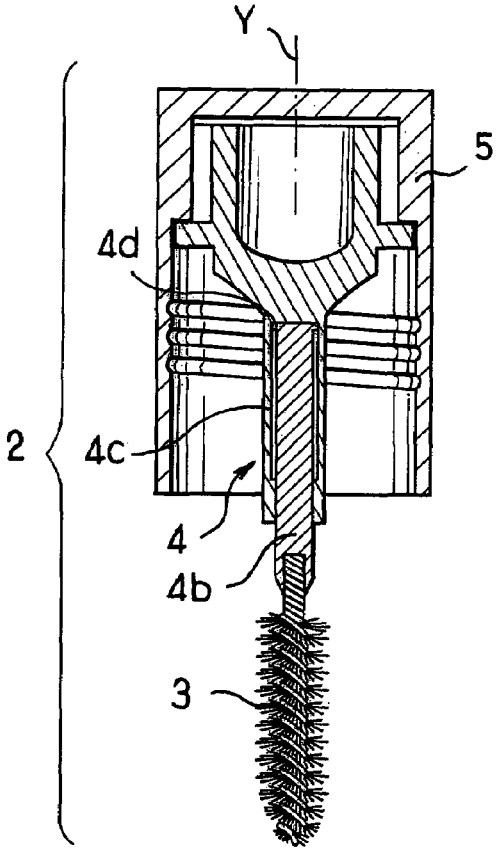
FIGS. 12 and 13 are axial section views of an exemplary applicator with a telescopic stem, the stem being shown respectively in a retracted position and in an extended position.
Figure 13:
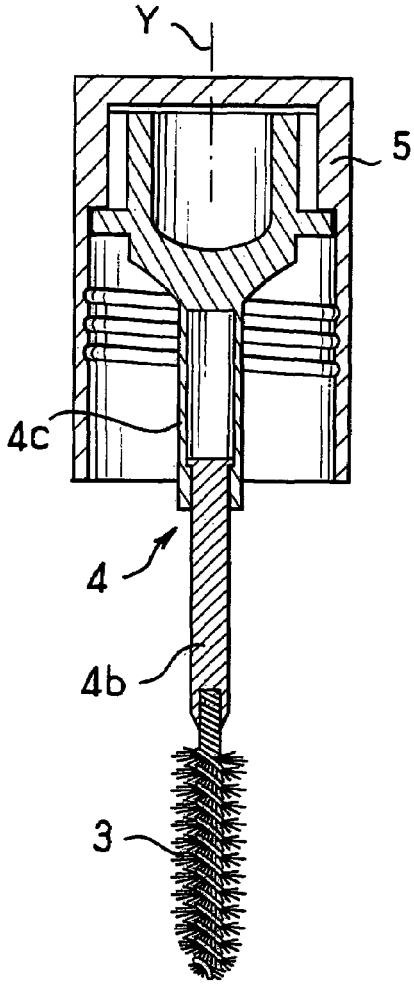

The stem 4 of the applicator may be telescopic, for example, as shown in FIGS. 12 and 13.

The stem 4 may comprise a first portion, for example, a bottom portion 4*b*, engaged inside a second portion, for example, a top portion 4*c*, and capable of sliding inside the second portion parallel to the longitudinal axis Y of the applicator. The bottom portion 4*b* may be made with one end in relief that enables a travel stroke thereof in the other portion 4*b* to be limited.

When the applicator 2 may be in place in the receptacle, the stem 4 may be in a retracted position, for example, as shown in FIG. 12.

When the user seeks to extract the applicator element 3 from the receptacle, the applicator element 3 may bear against the wiper member 30, thus enabling the stem 4 to be deployed and bringing the stem into the configuration shown in FIG. 13.

Once the stem 4 may be deployed, the user may cause the applicator element 3 to pass through the wiper member 30.

On returning the applicator element 3 into the receptacle, the stem 4 may begin by retracting, after which the applicator element 3 may pass through the wiper member 30.

Figure 14:
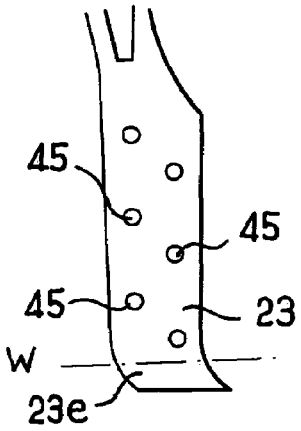
FIGS. 14 to 16 are elevation views showing exemplary perforated blades in isolation.
Figure 15:
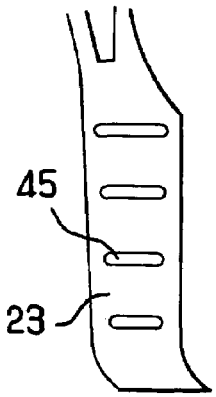
Figure 16:
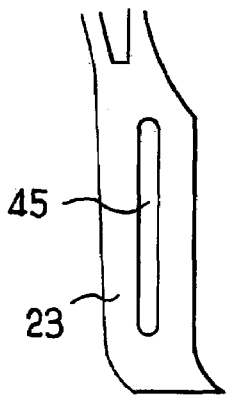

The use of a telescopic stem may be associated with receptacles other than that shown in FIG. 1.

Where appropriate or desired, as shown in FIGS. 14 to 16, openings 45 may be formed in the blade 23 so as to allow the substance to pass through the blade 23 while the blade 23 may be moving.

The blade 23 may have multiple openings 45, for example, circular openings, as shown in FIG. 14, horizontal slots, as shown in FIG. 15, or a single opening 45, which may be a single vertical slot, as shown in FIG. 16, for example.

The through section made available to the substance by the opening(s) 45 may preferably be small enough to ensure that the required quantity of substance nevertheless flows through the central region 15*c* when the blade 23 may be moved.

Where appropriate or desired, the blade 23 may be skew, for example, including a bottom portion that may be curved downward and forward relative to the direction the blade moves through the substance.

The blade 23 may include a portion 23*e* that may be curved about an axis W perpendicular to the turning axis X, as shown in FIG. 14, so as to lift the substance while the blade may be moving. This may oppose accumulation of substance at the bottom of the receptacle under the effect of gravity.

Instead of curving the blade, it may be also possible to make the blade thicker in a bottom portion thereof so that the surface 40 that presses again the substance tends to lift the substance.

A skew blade may be made without openings 45.

The present invention may be not limited to a particular applicator element 3. For example, FIG. 17 shows an exemplary embodiment in which the applicator element 3 comprises a flocked endpiece.

Figure 17:
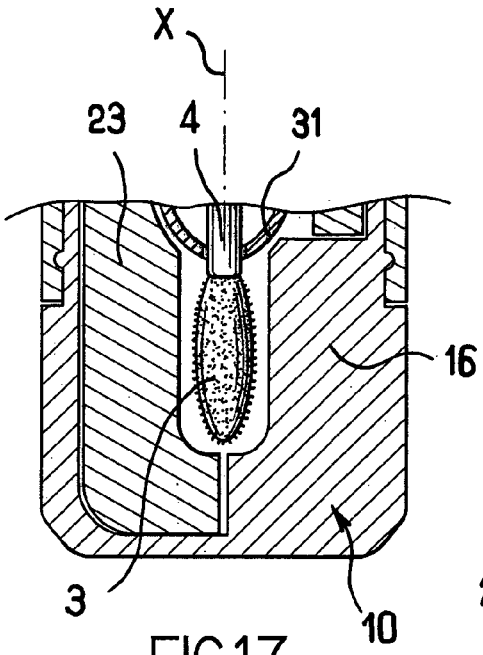
FIG. 17 may be a fragmentary and diagrammatic axial section view of another exemplary embodiment.

FIG. 17 also shows the possibility of making the first part 10 as a one-piece molding of plastics material, without using an outer covering 12.

As shown in FIG. 17, the blade 23 may be made with a shape that may be different. For example, the bottom portion thereof may be L-shaped, with the blade 23 extending under the applicator element 3 substantially as far as the axis X, for example.

The bottom portion of the partition 16 may likewise have an L-shape extending toward the inside substantially as far as the axis X.

The first and second parts may be organized in multiple other ways without that going beyond the ambit of the present invention.

Figure 18:
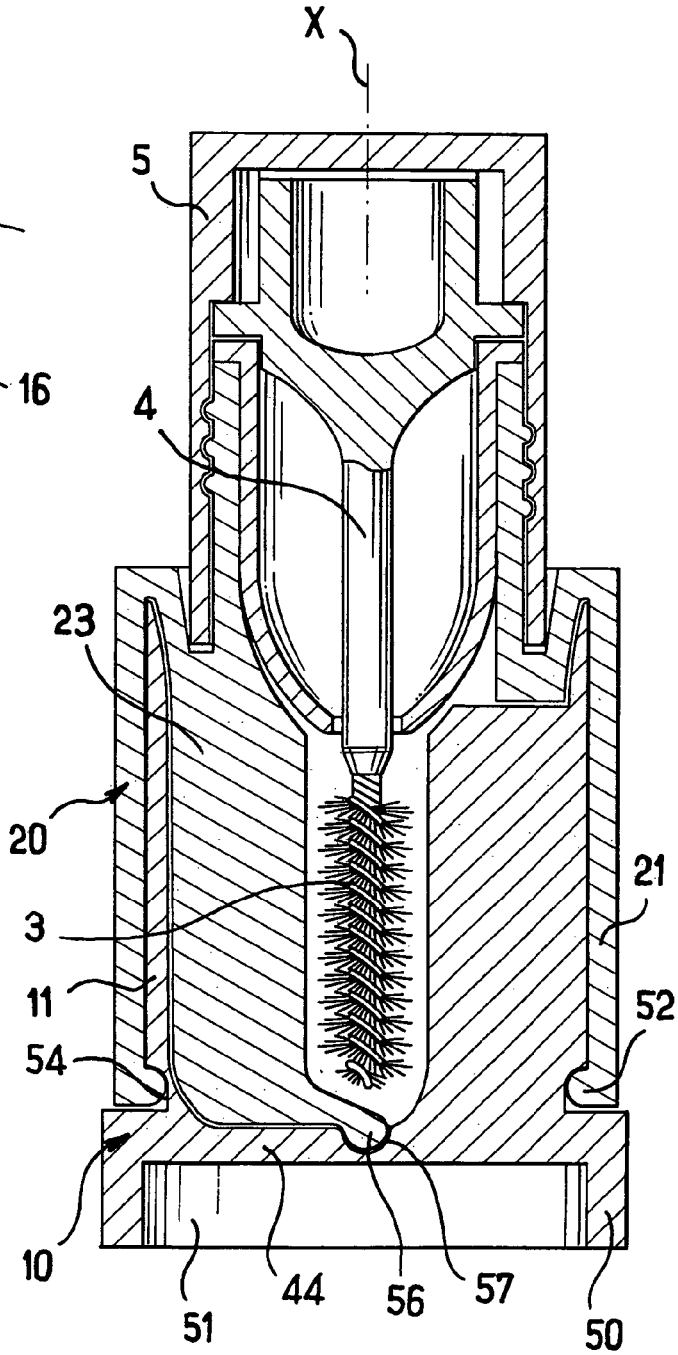
FIG. 18 may be a diagrammatic axial section view of another exemplary embodiment.

For example, FIG. 18 shows another exemplary embodiment in which the bottom wall 44 may be extended downward at a periphery thereof by a rib 50 that defines a housing 51, for example, that may be suitable for housing a mirror or a product sample (not shown).

In the exemplary embodiment of FIG. 17, the outer skirt 21 of the second part may be provided with at least one portion in relief, for example, an annular bead 52, which may be configured to engage in a corresponding groove 54 formed in the base of the pot 11.

FIG. 18 also illustrates that the blade 23 may be made with a first portion in relief, for example, a stud 56, that co-operates with a second portion in relief, for example, an indentation 57, made in the first part 10. The indentation 57 may be circularly symmetrical about the axis X so as to provide the bottom portion of the blade 23 with a certain amount of guidance while the second part 20 may be turning.

Figure 19:
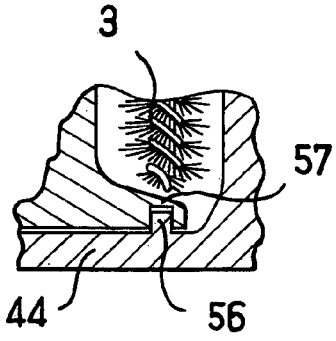
FIG. 19 may be a fragmentary axial section view of another exemplary embodiment, similar to the device of FIG. 18.

In the exemplary embodiment of FIG. 19, the stud 56 may be made integrally, i.e., monolithically, with the bottom wall 44 and the indentation 57 may be made integrally, i.e., monolithically, with the second part.

Where appropriate or desired, at least one of the first and second parts may be made with a chimney in which the applicator element 3 may be positioned when the applicator 2 may be in place on the receptacle.

Figure 20:
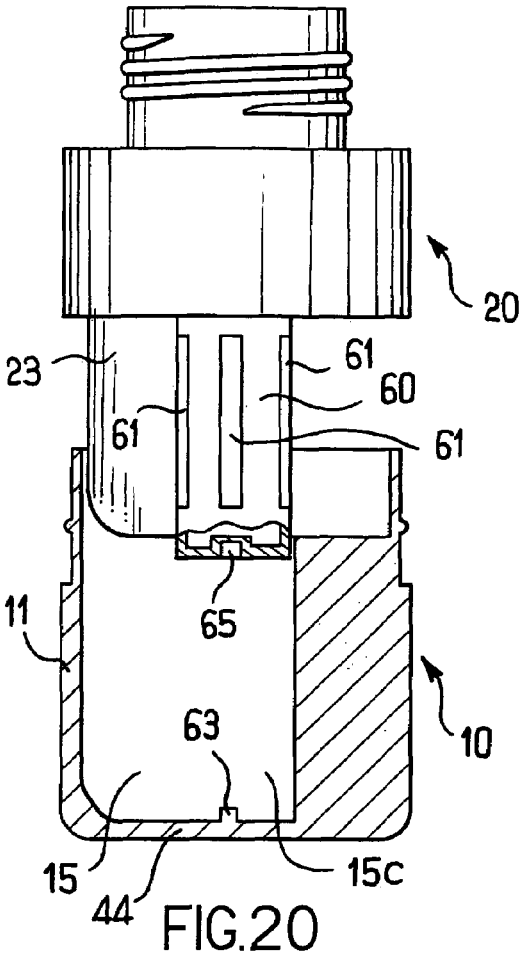
FIGS. 20 and 21 are diagrammatic exploded views, partially in axial section, of the first and second parts prior to assembly, in another exemplary embodiment.

In FIG. 20, the second part 20 may be made with a chimney 60 that engages in the central region 15*c* of the inside space 15 of the pot 11. The chimney 60 may be pierced by a plurality of openings 61 that enable the substance flowing from one of the chambers 15*a* or 15*b* toward the other chamber to pass therethrough and fill the applicator element 3 located therein.

The bottom wall 44 of the pot 11 may be made, where appropriate or desired, with a first portion 63 in relief, such as a stud, arranged to co-operate with a second portion 65 in relief, such as an indentation, formed in the bottom wall of the chimney 60.

Figure 21:
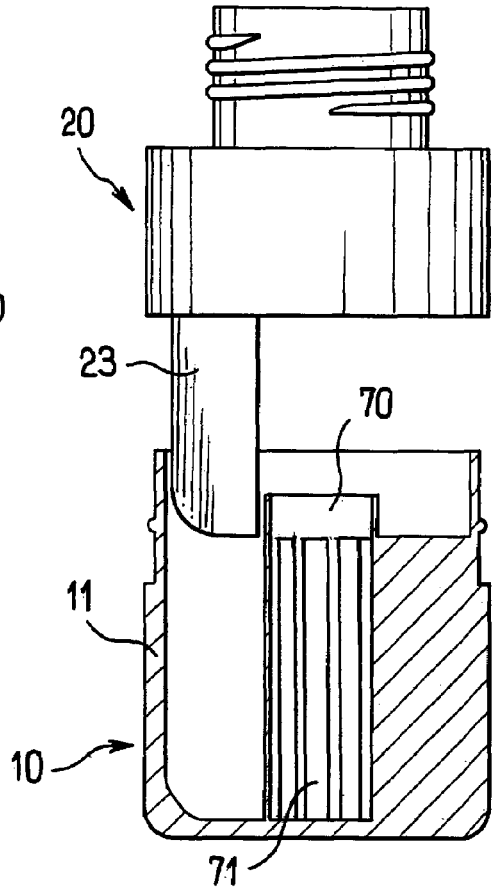

In the exemplary embodiment of FIG. 21, the first part 10 may be made with the chimney 70 that may include, like the chimney 60 described above, openings 71, for example, in the form of slots that are elongate parallel to the axis X.

The applicator element 3 may be received in the chimney 70 while the applicator 2 may be in place on the receptacle.

The second part 20 may be made as a single piece, by molding a plastics material, or in exemplary embodiments by assembling together at least two pieces that are made separately and then assembled together.

Figure 22:
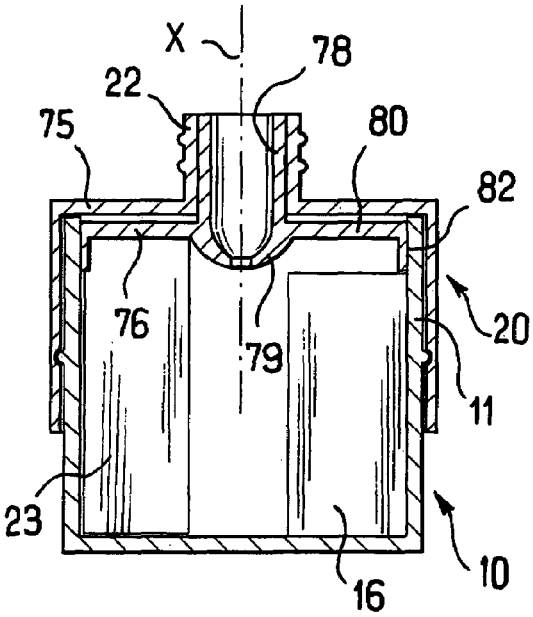
FIGS. 22 to 24 are diagrammatic and fragmentary axial sections of additional exemplary embodiments.

In the exemplary embodiment of FIG. 22, the second part 20 may include an outer portion 75 co-operating with the first part 10 to hold the second part 20 axially while allowing the second part 20 to turn about the axis X, and an inner portion 76 that turns together with the outer portion 75.

The outer portion 75 may be assembled to the inner portion 76 in various ways. The outer portion 75 may, for example, include the neck 22, and the inner portion 76 may include an insert 78 that may be engaged in the neck 22, the insert 78 being made, for example, integrally, i.e., monolithically, with a wiper member 79. The inner portion 76 may also include, for example, a plate 80 supporting the blade 23 and provided at its periphery with an annular sealing lip 82 that bears against the radially inside surface of the pot 11.

Figure 23:
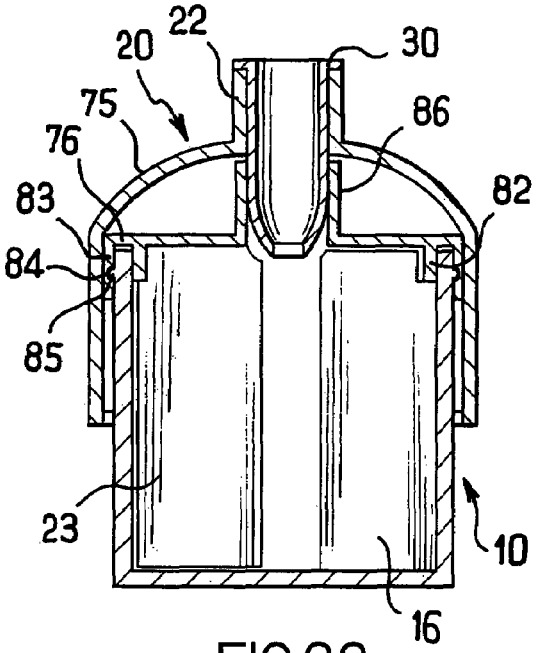

In the exemplary embodiment of FIG. 23, the second part 20 may likewise include an outer portion 75 and an inner portion 76. For example, the inner portion 76 may co-operate with the first part 10 to retain the second part 20 axially on the first part 10. The inner portion 76 may comprise, for example, an outer skirt 83 with an inside groove 84 including an outside bead 85 of the pot 11 engaged therein to hold the second part 20 axially while allowing the second part 20 to turn about the axis X. The inner portion 76 may also include an annular sealing lip 82 pressing against the radially inside surface of the pot 11. The outer portion 75 may be assembled with the inner portion 76 by friction, for example. The wiper member 30 may be fitted in the neck 22 which may be formed together with the outer portion 75, and may engage in a leaktight manner in a chimney 86 formed together with the outer portion 75.

Figure 24:
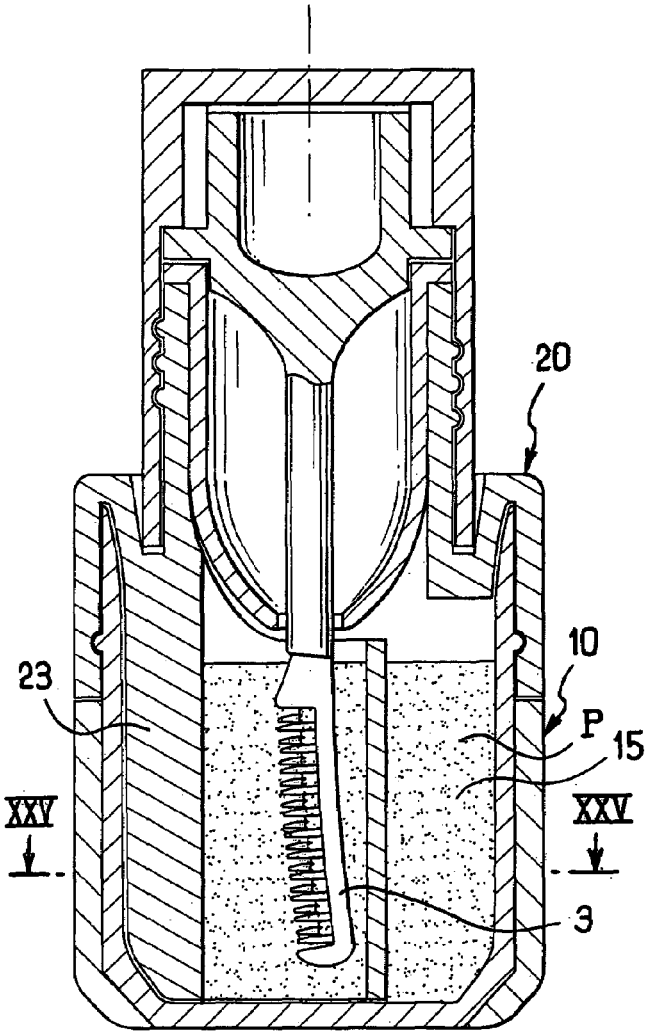
Figure 25:
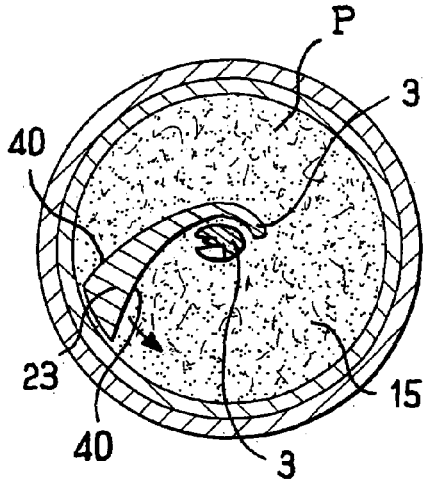
FIG. 25 may be a cross-section view taken along XXV-XXV of FIG. 24.

In the exemplary embodiments described above, the first part 10 may include a partition 16 defining at least one backing surface 46. It would not go beyond the ambit of the present invention for the first part 10 to include no such partition, as shown in FIGS. 24 and 25. In such embodiments, the second part 20 may include a blade 23 defining two rotary surfaces 40, at least one of which having a shape that may be curved in such a manner as to deflect the substance toward the center when said blade 23 may be turned in the appropriate direction, for example, the counterclockwise direction in the exemplary embodiment of FIG. 25.

In the exemplary embodiment of FIGS. 24 and 25, the inside space 15 may include only one chamber. The substance P may be moved inside said chamber when the second part 20 turns relative thereto.

In FIG. 24, the possibility of making the applicator in a form other than a brush is illustrated, for example in the form of a comb made by injection-molding a plastics material.

In the exemplary embodiments described above, the applicator may be extracted from the receptacle in a direction that may be substantially parallel to the axis of rotation X.

Figure 26:
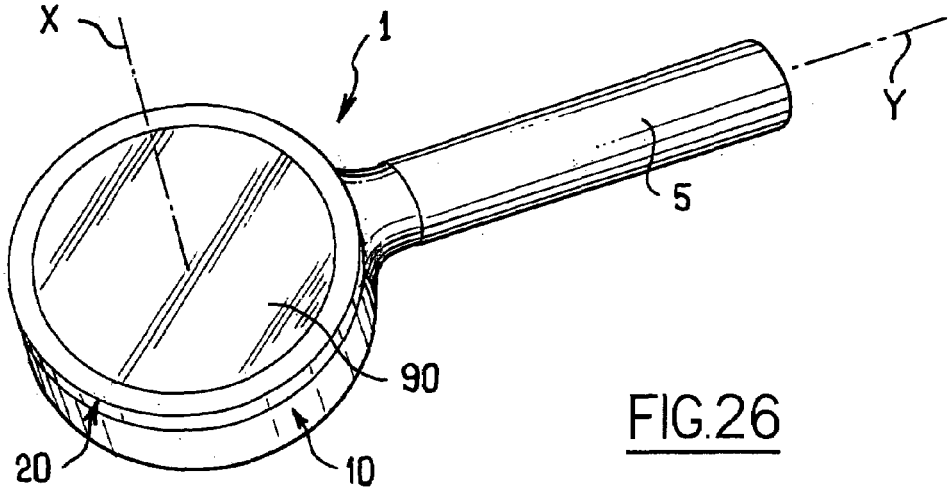
FIG. 26 may be a diagram of a device according to another exemplary embodiment.
Figure 27:
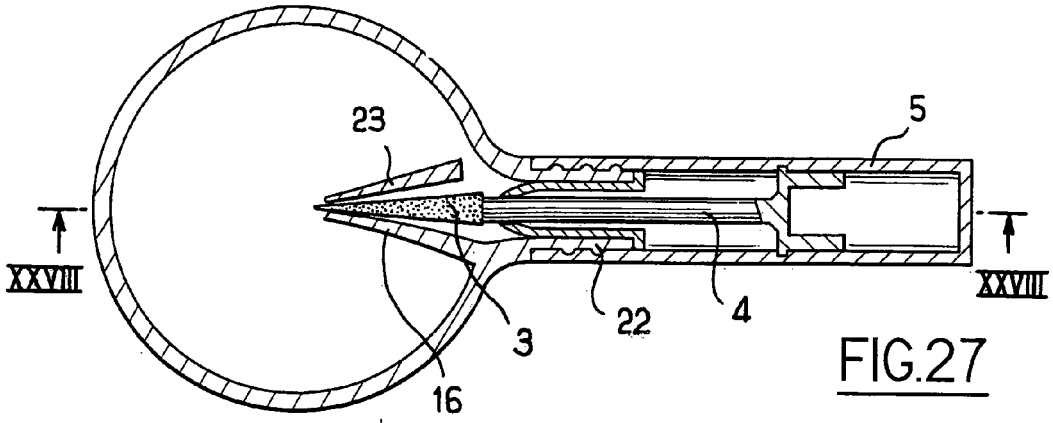
FIG. 27 may be a diagrammatic and fragmentary longitudinal section view in a midplane of the device of FIG. 26.
Figure 28:
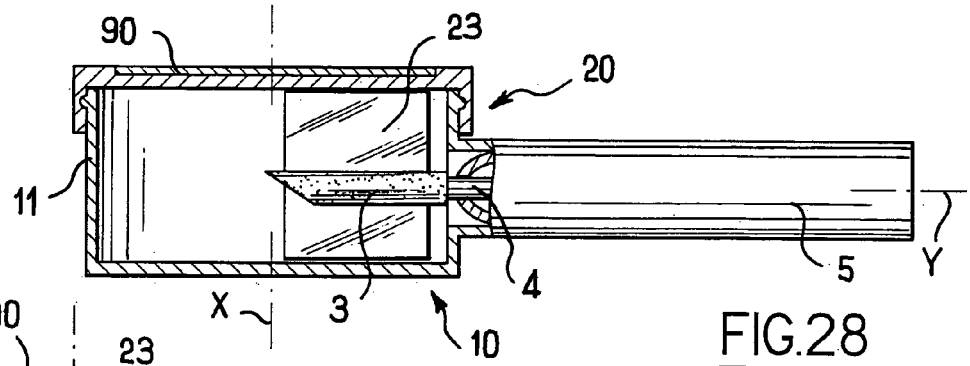
FIG. 28 may be a fragmentary and diagrammatic section view taken along XXVIII-XXVIII of FIG. 27.

It would not go beyond the ambit of the present invention for the applicator to be extracted in a direction that may not be parallel to the axis X, and for example, in a direction Y that may be perpendicular to the axis X, as applies to the exemplary embodiment shown in FIGS. 26 to 28.

In this exemplary embodiment, the device 1 may comprise a first part 10 made with a neck 22 extending substantially perpendicularly to the axis X from the side of the first part 10. The pot 11 of the first part 10 may be closed by the second part 20. For example, the partition 16 may be made integrally, i.e., monolithically, with the pot 11 by molding material. The second part 20 may carry a mirror 90 on an outside face and a blade 23 which extends substantially parallel to the axis of rotation X.

The closure cap 5 may have an elongate shape so as to form a handle for the device 1 when the user seeks to make use of the mirror 90. This example shows that it may be possible for the applicator element to be constituted by an element other than a brush, and specifically by an endpiece having a tapering tip, for example.

Figure 29:
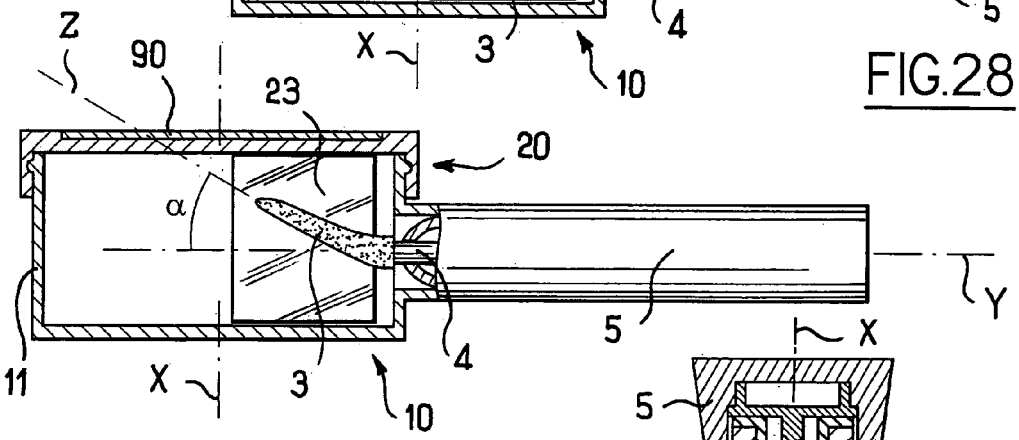
FIG. 29 may be a view analogous to FIG. 28 showing another exemplary embodiment.

In FIG. 29, the possibility of making the applicator element 3 of the applicator to have a longitudinal axis Z that makes a non-zero angle $\alpha$ with the longitudinal axis Y of the applicator is illustrated.

Figure 30:
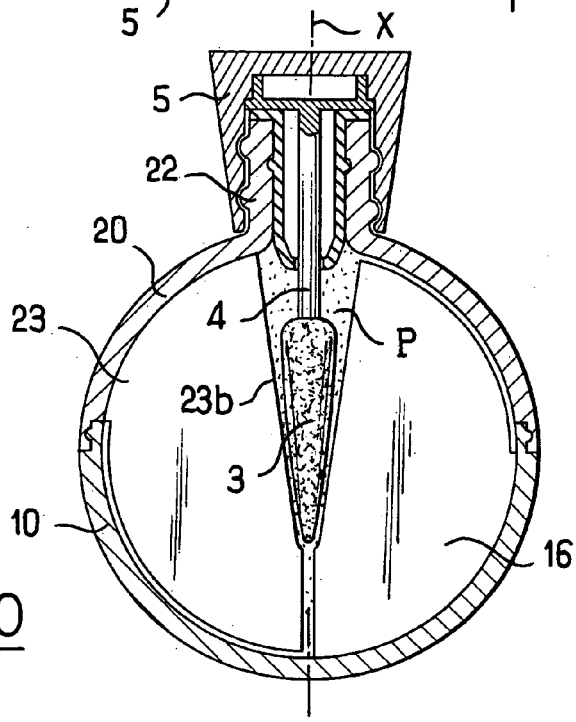
FIG. 30 may be a diagrammatic axial section view of another exemplary embodiment.

FIG. 30 shows an exemplary embodiment in which each of the first and second parts includes a portion that may be substantially hemispherical. In FIG. 30, the radially inner edge 23*b* of the blade 23 may match substantially the profile of the applicator element. In this embodiment, the bottom of the receptacle may be not planar.

In the exemplary embodiments described above with reference to the drawings, the applicator 2 may comprise an applicator element 3 that is to be extracted from the device during utilization, and that may be mounted at the end of the stem 4. In such embodiments, the applicator element 3 may be housed inside the receptacle containing the substance whenever the closure cap 5 is in place on the receptacle.

It would not go beyond the ambit of the present invention for the applicator element 3 to be permanently secured on the device and/or not to be housed while not in use entirely in the space containing the substance.

Figure 31:
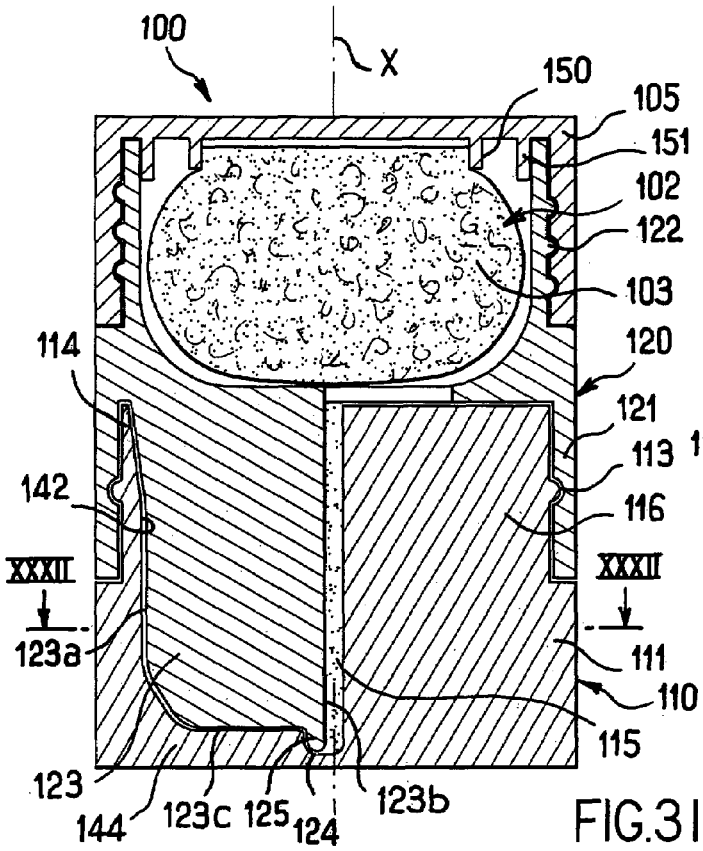
FIG. 31 may be a diagrammatic axial section view of an exemplary embodiment in which the applicator may be outside the space containing the substance.
Figure 32:
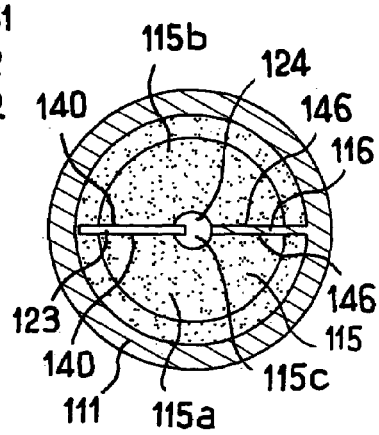
FIG. 32 may be a cross-section view taken along XXXII-XXXII of FIG. 31.

For example, FIGS. 31 and 32 show a device 100 having a first part 110 and a second part 120 that is capable of turning relative to the first part 110 about an axis of rotation R coinciding with the longitudinal axis of the device.

The device 100 may further comprise an applicator 102, which in this exemplary embodiment may comprise an applicator element 103, for example, comprising a foam, said applicator element 103 being carried by an inner skirt 150 of a closure cap 105 that may also act as a handle.

The cap 105 may include an annular sealing lip 151 pressing against the inside wall of a neck 122, which neck may carry an outside thread, for example, and may be made integrally, i.e., monolithically, with the second part 120.

In the exemplary embodiment described, the first part 110 may comprise a pot 111 defining an inside space 115, as shown in FIG. 32, with the substance being contained therein.

The pot 111 may include a partition 116 extending radially toward the center of the inside space 115 to come close to the axis X, and near the top may include an annular sealing lip 114 provided on the outside with a portion 113 in relief serving to hold the second part 120. For example, the portion 113 in relief may be an annular bead.

The second part 120 may comprise an outer skirt 121 arranged to snap-fasten on the portion 113 in relief, and made integrally, i.e., monolithically, with the neck 122 in exemplary embodiments.

A blade 123 may also be made integrally, i.e., monolithically, with the outer skirt 121 and the neck 122 in exemplary embodiments.

The radially inner edge 123*b* of the blade 123 may be situated in a central region 115*c* of the inside space 115, preferably at a short distance from the radially inner edge of the partition 116.

In exemplary embodiments, the bottom wall 144 of the pot 111 may include a first portion in relief, for example, constituted by an indentation 124, that may be arranged to co-operate with a second portion in relief, for example, constituted by a stud 125, formed on the bottom edge 123*c* of the blade 123, so as to guide the blade 123 when turning.

The radially outer edge 123*a* of the blade 123 may extend nearly as far as the inside wall 142 of the pot 111, for example, so as to scrape off the substance that becomes deposited on said wall 142.

The device of FIGS. 31 and 32 may operate as follows.

The blade 123 may define two opposite rotary surfaces 140 and the partition 116 may define two associated backing surfaces 146.

The partition 116 may co-operate with the blade 123 to define two chambers 115*a* and 115*b*. When the second part 120 is turned relative to the first part 110, the blade 123 moves, and its movement may be accompanied by the volume of one of the chambers 115*a* or 115*b* decreasing and the substance leaving that volume to go toward the applicator element 103.

Figure 34:
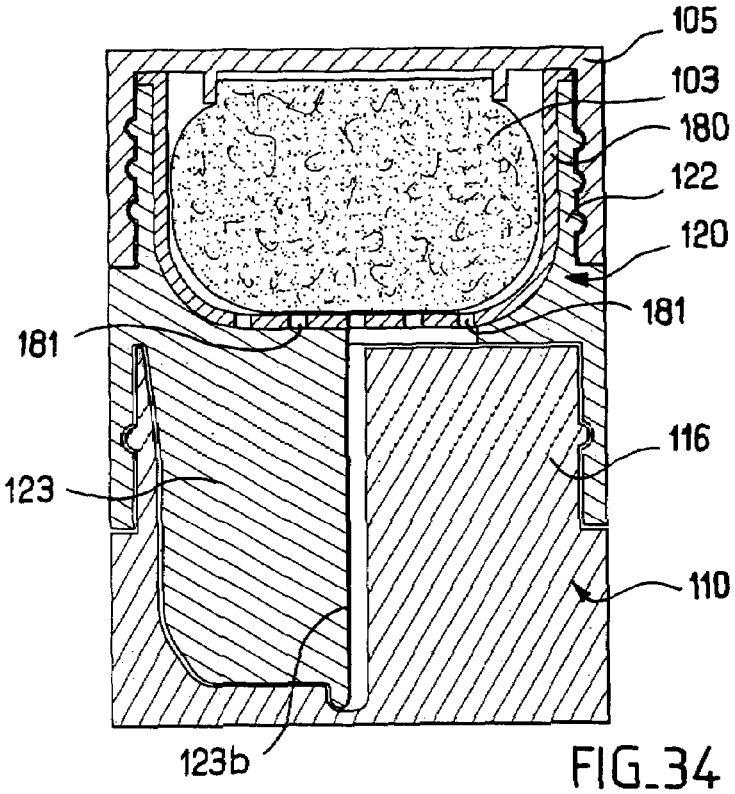

FIG. 34 illustrates the possibility of interposing a permeable wall 180, for example, including a sieve or a grid, and defining at least one opening 181, or even a plurality of openings 181, between the applicator element 103 and the inside space 115.

Figure 33:
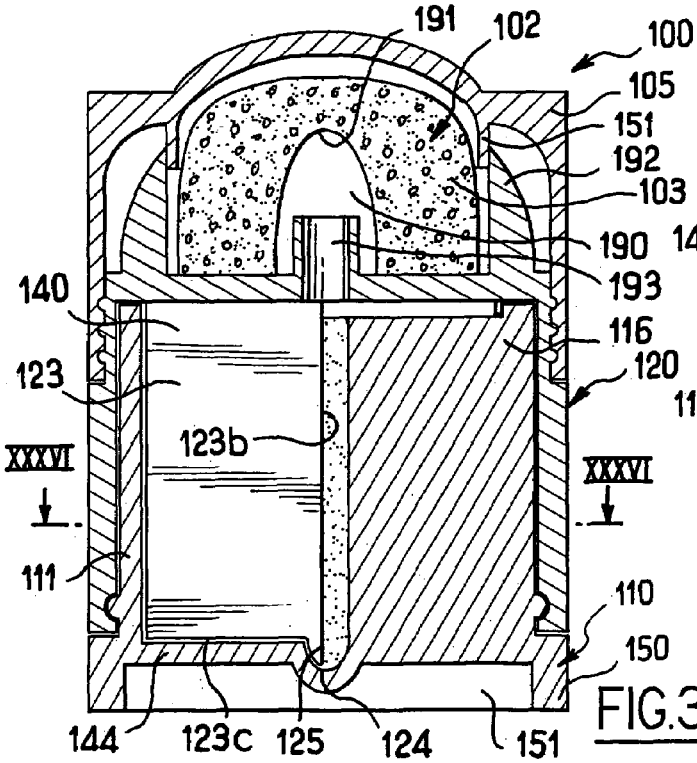
FIGS. 33 to 35 are diagrammatic axial section views of other exemplary embodiments similar to that shown in FIG. 31.
Figure 36:
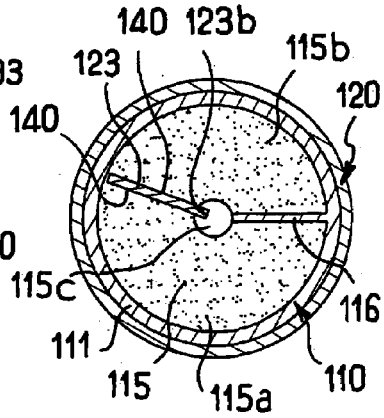
FIG. 36 may be a cross-section view taken along XXXVI-XXXVI of FIG. 33.

In the exemplary embodiment of FIG. 33, the applicator 102 may be secured not to the closure cap 105, but to the second part 120.

In the exemplary embodiment shown, the applicator element 103 may comprise a foam, for example, including a recess 190 defining an inside surface 191 arranged to receive the substance P when the second part 120 is turned.

The closure cap 10S may have an annular sealing lip 151 co-operating with a wall 192 of the second part 120 that may extend around the applicator element 103.

FIG. 33 also shows that the cap 105 may have various shapes, and, for example, a top wall of a shape that matches the shape of the applicator element 103.

In the exemplary embodiment of FIG. 33, the blade 123 may be made with a portion 125 in relief, for example, constituted by a stud, co-operating with a second portion 124 in relief, for example, constituted by an indentation in the bottom wall 144 of the pot 111.

This bottom wall may be extended downward at a periphery thereof by a skirt 150 defining a housing 151, for example, suitable for housing a mirror or a sample of substance. In the exemplary embodiment shown, the bottom wall 144 has a bulge in the housing 151 that enables the indentation 124 to be formed.

In the same manner as that described with reference to FIG. 31, the substance P may be housed in the inside space 115 in two chambers 115*a* and 115*b* of the pot 111, which chambers may be defined by the blade 123 and by the partition 116.

The substance P may be expelled toward the applicator element when the blade 123 is turned in either direction by the user. A duct 193 may be formed integrally, i.e., monolithically, with the second part 120 to convey the substance P coming from the pot 111 toward the recess 190. The substance P coming into contact with the inside surface 191 of the applicator element 103 may serve to feed the applicator element.

Figure 35:
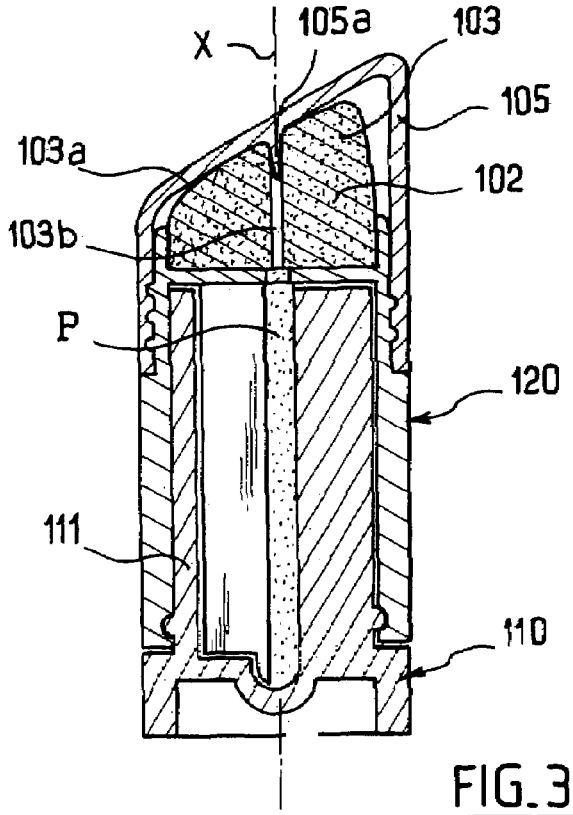

In FIG. 35, the applicator element 103 may be intended to apply substance to the lips and may include a top face 103*a* that slopes relative to the axis of rotation X. This top face 103*a* may be fed with substance via a channel 103*b* passing through the applicator element 103. The channel 103*b* may be closed while the closure cap 105 is in place by a peg 105*a* of the cap.

Naturally, the invention is not limited to the embodiments described above.

For example, the outside shape of the closure cap, of the first part 10, or of the second part 20 may be modified without thereby going beyond the ambit of the present invention.

For example, FIGS. 37 to 49 show various examples amongst others of possible shapes for the cap 5, for the first part 10, and for the second part 20.

The possible shapes may vary along the longitudinal axis Y or along any transverse axis, for example.

The shapes shown in FIGS. 37 to 49 are equally applicable to the embodiments of FIGS. 31 to 36, with the reference symbols 5, 10, and 20 being replaced by 105, 110, and 120, respectively.

Figure 37:
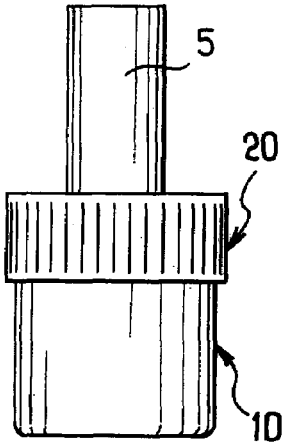

In the exemplary embodiment of FIG. 37, the outer skirt of the second part 20 may project radially outward from the first part 10.

Figure 38:
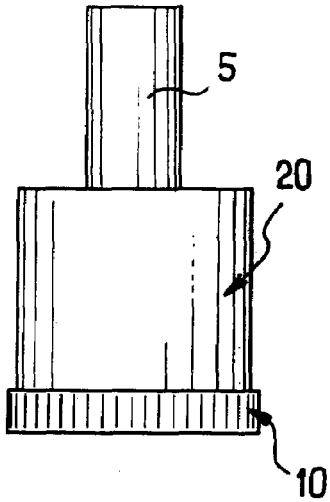

In the exemplary embodiment of FIG. 38, the first part 10 may project radially outward relative to the second part 20.

Figure 39:
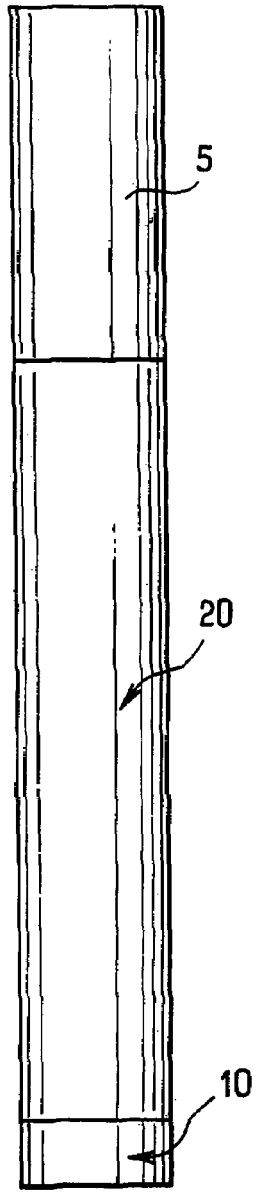
FIGS. 37 to 43 are elevation views of additional exemplary embodiments.

In the exemplary embodiment of FIG. 39, the general shape of the device may be clearly elongate, like a pen.

Figure 40:
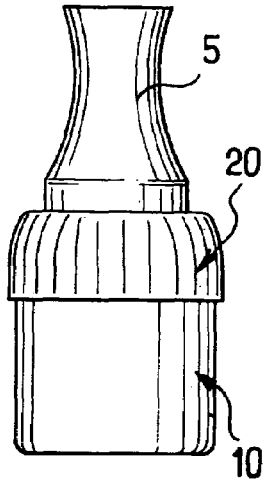

FIG. 40 illustrates that the closure cap 5 may be made with a shape that may be outwardly concave, so as to make the cap 5 easier to grasp.

Figure 41:
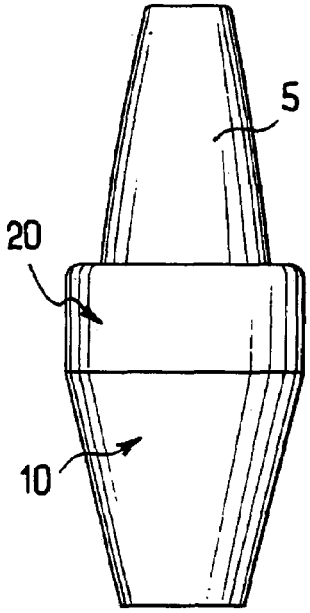

In FIG. 41, the closure cap 5 may have the shape of a truncated bullet and the first part 10 may be frustoconical in shape, with its outer cross-section tapering downward.

Figure 42:
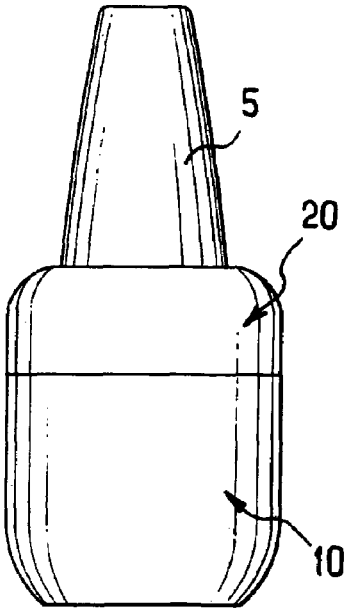

In FIG. 42, the first and second parts 10 and 20 may include rounded edges.

Figure 43:
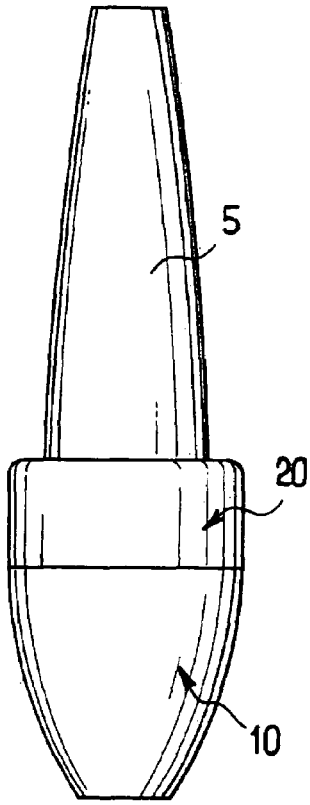

In FIG. 43, the height of the closure cap 5 may be greater than the height of the first and second parts 10 and 20 when assembled together.

The first part 10 may have a double wall, with an outer wall 99 and an inner wall 11, for example, having different bottom cross-sections.

Figure 44:
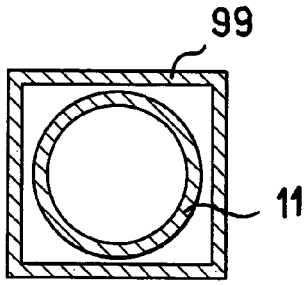
FIG. 44 may be a cross-section view showing, in isolation, the first part of a device according to another exemplary embodiment.
Figure 45:
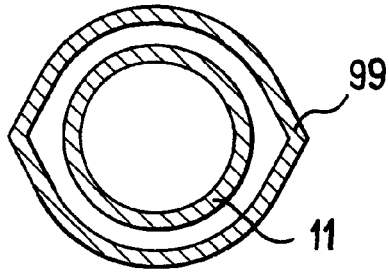
FIG. 45 may be a view analogous to FIG. 44 showing another exemplary embodiment.

For example, the outer wall 99 may have a cross-section that may be substantially square or rectangular, as shown in FIG. 44, or may have some other shape, for example, lenticular, as shown in FIG. 45.

Figure 77:
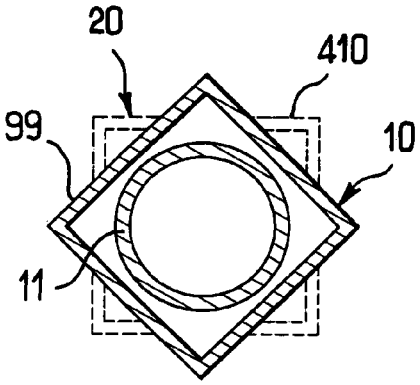
FIG. 77 may be a cross-section view analogous to FIG. 44.

The second part 20 may also have a double wall, having an outer wall 410, and the outlines of the walls 99 and 410 may coincide in certain angular positions only of the first part relative to the second part, as shown in FIG. 77.

Figure 46:
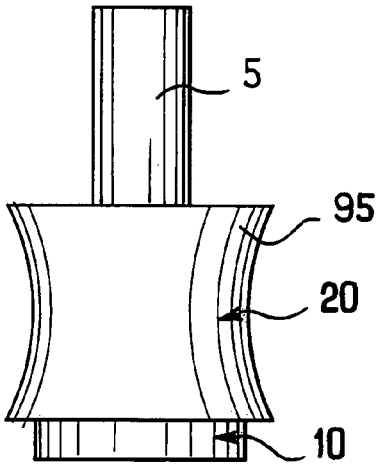
FIGS. 46 to 48 are elevation views of further exemplary embodiments.
Figure 47:
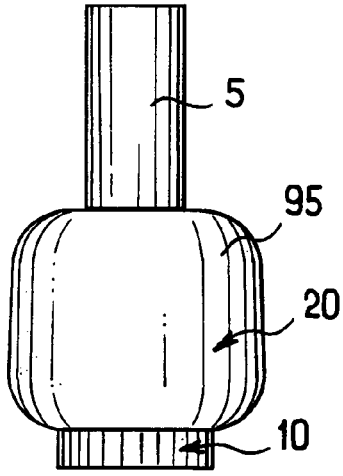

The second part 20 may have an outer covering 95, for example, made of elastomer, as shown in FIGS. 46 and 47.

In FIG. 46, the outer covering 95 may be in the form of a sleeve that co-operates, for example, by friction, with the outer skirt 21 that may be not visible in FIG. 46. For example, the sleeve may have an outwardly concave axial section over its entire circumference.

In FIG. 47, the outer covering 95 may be likewise in the form of a sleeve, which may be generally outwardly convex in shape.

Figure 48:
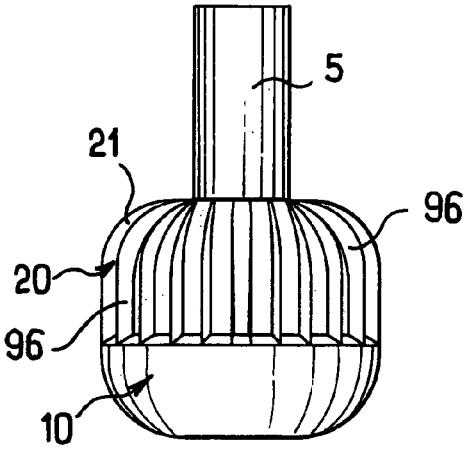

Portions in relief may be formed on the outer skirt 21 of the second part 20, for example, fins 96 as shown in FIG. 48.

Figure 49:
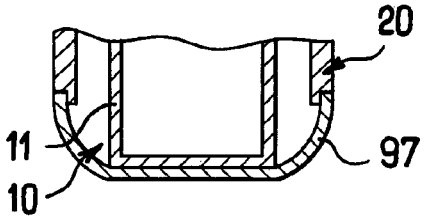
FIG. 49 may be a diagrammatic and fragmentary axial section view of an additional exemplary embodiment.

It may be also possible to cover one and/or the other of the first and second parts 10 and 20 with a double wall 97, as shown in FIG. 49, thus giving the impression of volume.

Figure 50:
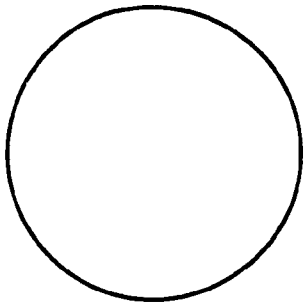
FIGS. 50 to 53 are diagrams showing examples of cross-sectional shapes for the receptacle.
Figure 51:
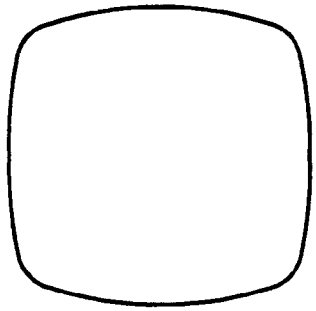
Figure 52:
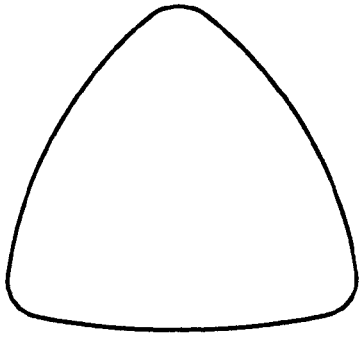
Figure 53:
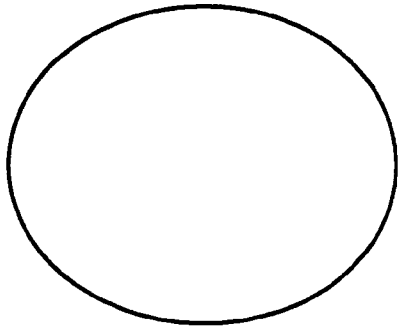

The cross-section of the first and/or second part may have a variety of shapes at at least one point along the axis Y, for example, generally circular as shown in FIG. 50, substantially square, possibly with rounded corners, as shown in FIG. 51, substantially triangular as shown in FIG. 52, for example, with rounded corners, or substantially oval, as shown in FIG. 53.

Within a single device, the cross-section of the first and/or the second part may vary along the longitudinal axis X.

Figure 54:
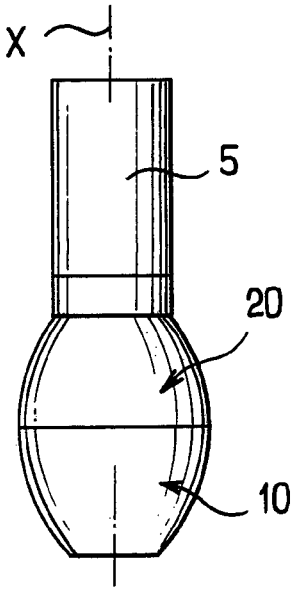
FIG. 54 may be a diagrammatic elevation view of another exemplary embodiment.

For example, FIG. 54 shows a device in which the cross-section goes from being oval in shape at its bottom end to being circular in shape at a junction between the first part 10 and the second part 20, and subsequently returning to an oval shape toward the top of the receptacle, under the closure cap 5.

Such variation in the shape of the cross-section of the receptacle while having a circular junction between the first and second parts may make it possible to provide a receptacle of original shape without harming sealing, and may make it easier to grasp the first and second parts to turn one relative to the other.

Figure 55:
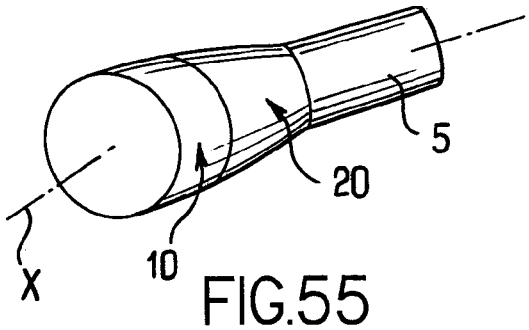
FIG. 55 may be a diagrammatic and perspective side view of another exemplary embodiment.

In FIG. 55, the first part 10 may have a cross-section that may be generally circular, and in cross-section at the bottom end of the second part 20 that changes toward a shape that may be substantially square at the top of the receptacle under the cap 5.

Whatever the shape of the receptacle, the closure cap 5 may include a locking system that enables the cap 5 to be held substantially stationary relative to one of the first and second parts. Because of the locking system, the cap 5 may not become unscrewed when the first part 10 turns relative to the second part 20. This may make it easier for the user to turn one of the parts.

Figure 80:
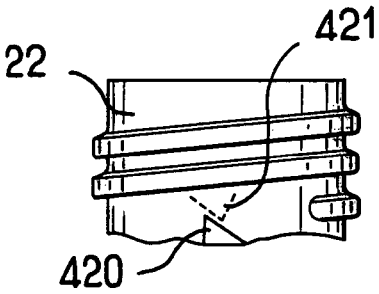
FIG. 80 shows how the neck may be made with means for preventing the closure cap from becoming unscrewed.

For example, and as shown in FIG. 80, the locking system may comprise a pawl 421 that snaps against a ratchet formed in one of the first and second parts when the closure cap 5 may be screwed home.

To unscrew the closure cap, the pawl must escape from the ratchet 420 in the opposite direction. The force that must be exerted in order to enable the pawl to escape in the opposite direction may be greater than the force needed to turn one of the parts relative to the other. Thus, the user may make use of the closure cap as a handle for causing the first part to turn relative to the second part in one direction only or in a plurality of back-and-forth movements, depending on the desired result. Thereafter, to proceed with application, the user may turn the cap more strongly while holding the two parts 10 and 20 stationary relative to each other so as to cause the pawl to escape from the ratchet. Where appropriate or desired, some additional action may need to be exerted on the cap to make it possible and/or easier to cause the pawl to escape from the ratchet. For example, a force may be exerted axially on the cap, depending on the configuration of the ratchet and of the closure cap.

Figure 56:
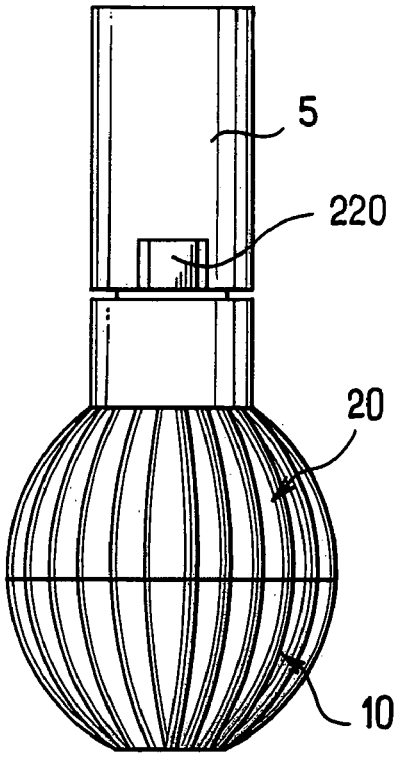
FIGS. 56 and 57 are diagrammatic elevation views of another exemplary embodiment.
Figure 57:
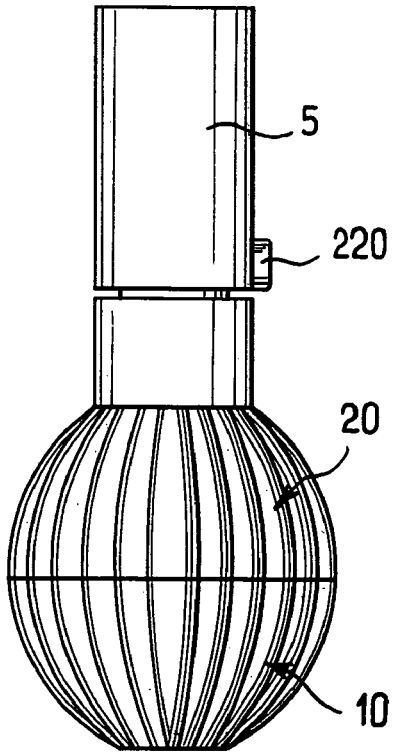

In an exemplary embodiment shown in FIGS. 56 and 57, the locking system may include a pushbutton 220 on the closure cap, or in an exemplary embodiment (not shown) on one of the first and second parts, serving optionally to secure the closure cap in rotation together with one of the first and second parts.

When the user presses the pushbutton 220 and turns the second part 20 relative to the first part 10, the closure cap 5 may remain secured to one of the parts and may not become unscrewed.

Figure 58:
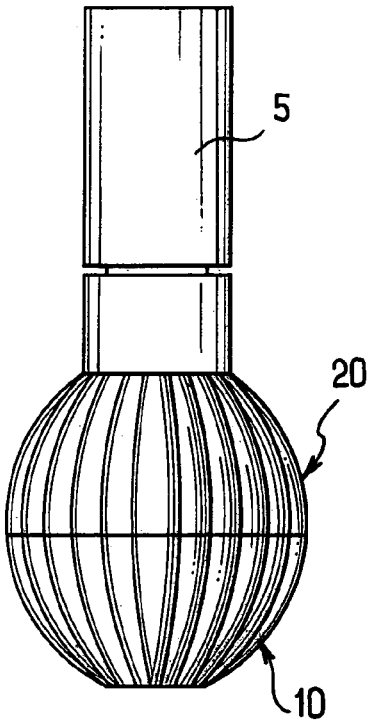
FIG. 58 may be a diagrammatic elevation view of another exemplary embodiment.
Figure 59:
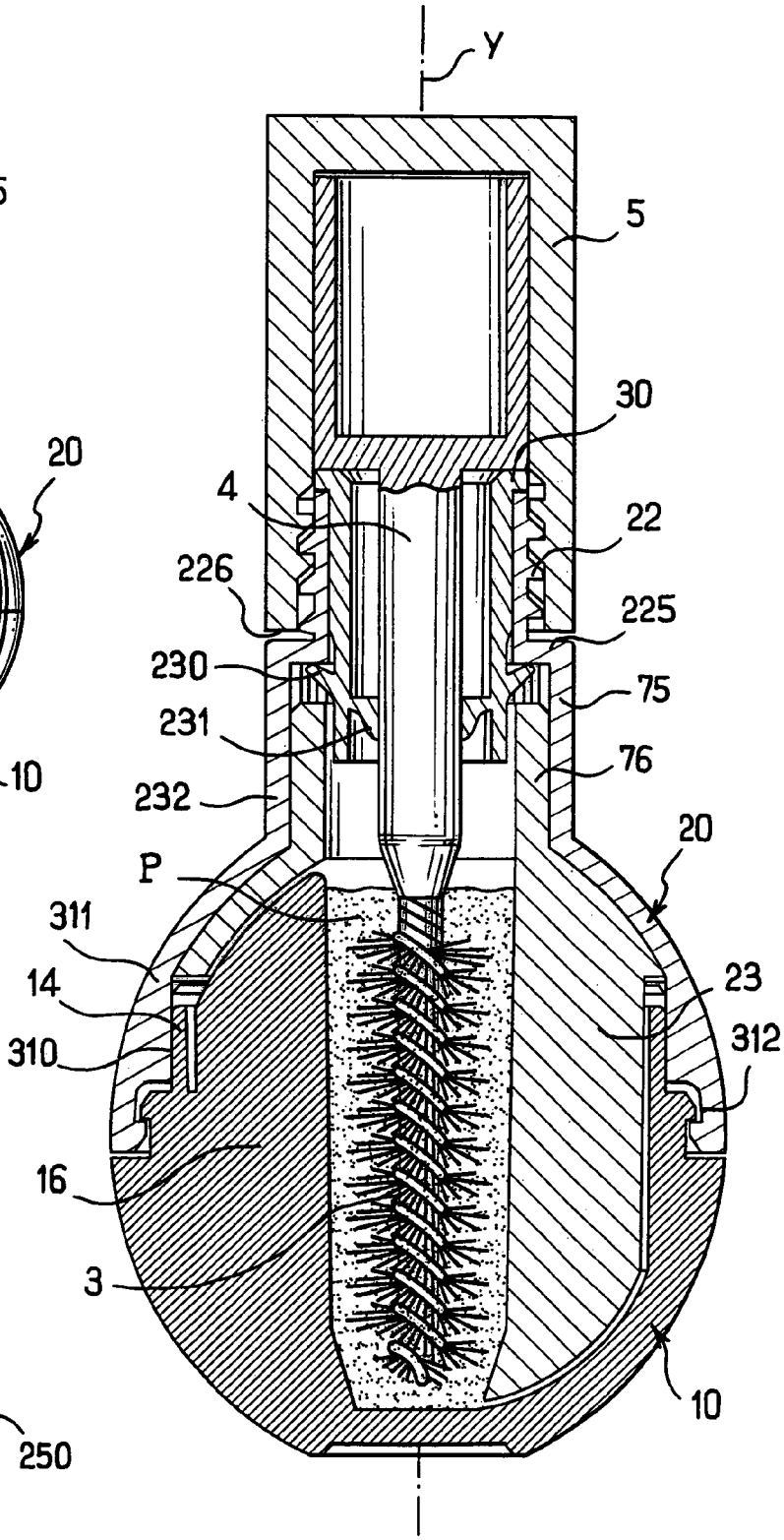
FIG. 59 may be a diagrammatic axial section view of the device of FIG. 58.

FIGS. 58 and 59 show another exemplary embodiment of a device in which the receptacle includes broad longitudinal ribs on the outside.

The second part 20 may include an outer portion 75 with a neck 22 having an outside thread, onto which the closure cap 5 may be screwed.

The bottom of the neck 22 may be connected to a shoulder 225.

The wiper member 30 may rest on the top edge of the neck and may include an annular holding lip 230 that bears against the underside of the shoulder 225.

The wiper member 30 may include a wiper lip 231 extending inward and, in the exemplary embodiment shown, with the device being in the closed position, the wiper lip 231 may bear against the stem 4 of the applicator 2.

The outer portion 75 may include a generally cylindrical portion 232 extending downward under the shoulder 225 in line with the closure cap 5.

This cylindrical portion 232 may be fluted internally so as to make it easier to keep the inner portion 76 firmly secured against moving inside the outer portion 75, for example, with clamping in the cylindrical portion 232.

The inner portion 76 may carry the blade 23 in the exemplary embodiment described.

The bottom of the generally cylindrical portion 232 may be connected to a portion 311 of generally hemispherical shape, including a circularly cylindrical surface 310 against which a sealing lip 14 of the second part 10 may bear.

As shown, the portion 311 may include an internal angular groove 312 into which the first part 10 may snap-fasten.

The first part 10 may be made as a single piece in the exemplary embodiment shown, for example, by molding a plastics material.

For example, the applicator element 3 may be a mascara brush, but may be any other type of applicator element without going beyond the ambit of the invention.

Figure 60:
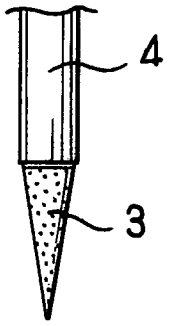
FIG. 60 may be a diagrammatic and fragmentary view of another exemplary embodiment of an applicator element.

For example, the applicator element 3 may be an endpiece with a greatest transverse dimension that may be less than the diameter of the rod, as shown in FIG. 60.

Figure 61:
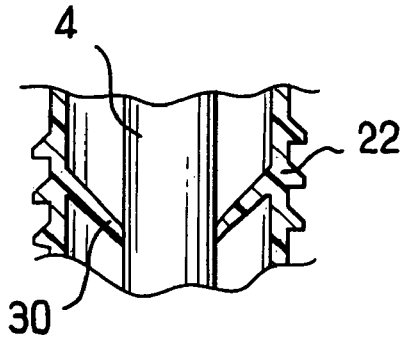
FIG. 61 may be a diagrammatic and fragmentary view showing an exemplary embodiment of a wiper member.

As shown in FIG. 61, the wiper member 30 may include a wiper lip made integrally, i.e., monolithically, with the neck 22 and extending inside the lip to perform its wiping function.

Figure 62:
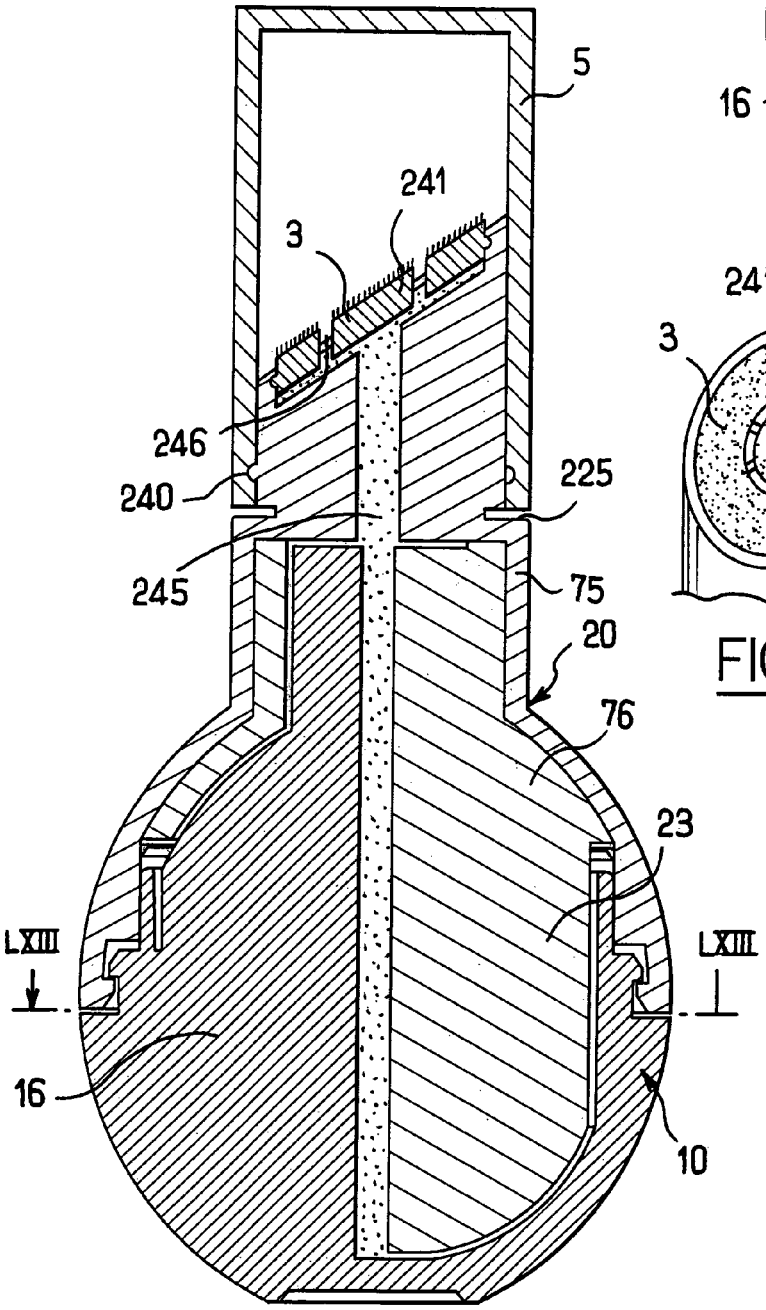
FIG. 62 may be a diagrammatic axial section view of another exemplary embodiment.
Figure 63:
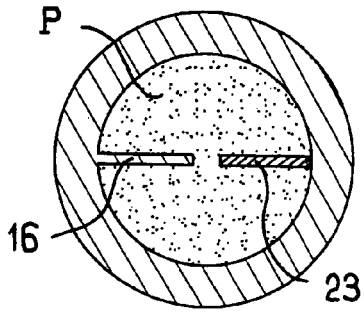
FIG. 63 may be a cross-section view taken along LXIII-LXII of FIG. 62.

In the exemplary embodiment of FIG. 62, the device may have an outside shape similar to the device of FIG. 59, but may have some other shape as well.

The device of FIG. 62 may be for applying a substance that may be liquid or that has some other constituency, for example, lipstick, and the applicator element 3 may be permanently secured to the second part 20.

For example, the applicator element 3 may comprise a flocked grid 241 secured to the top end of the neck, which may include an outside bead 240 onto which a corresponding annular groove of the closure cap 5 may snap-fasten.

The grid 241 may preferably be dispensed at an angle to make it easier to apply the substance to the lips, for example.

Figure 64:
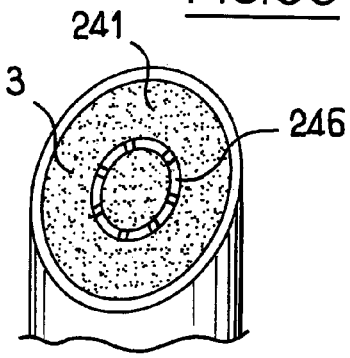
FIG. 64 may be a diagrammatic perspective view of the applicator element of the device of FIG. 62.

On turning the first part 10 relative to the second part 20, the substance may be brought toward the applicator element 3 via a chimney 245, and may move to the outside through an annular groove 246, as shown in FIG. 64.

Figure 65:
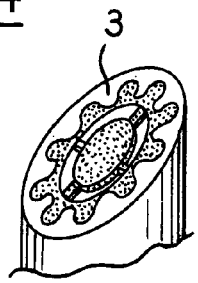
FIGS. 65 and 66 are diagrammatic perspective views of other exemplary embodiments of applicator elements.

The grid 241 may have a variety of shapes, and may optionally be flocked in full or in part, as shown in FIG. 65.

Figure 66:
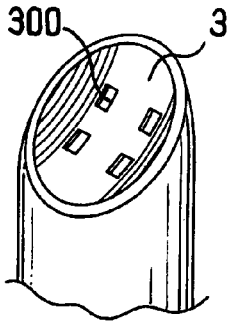

The applicator element 3 may comprise an elastomer, for example, a thermoplastic elastomer, that may be provided with one or more orifices 320, as shown in FIG. 66.

Figure 67:
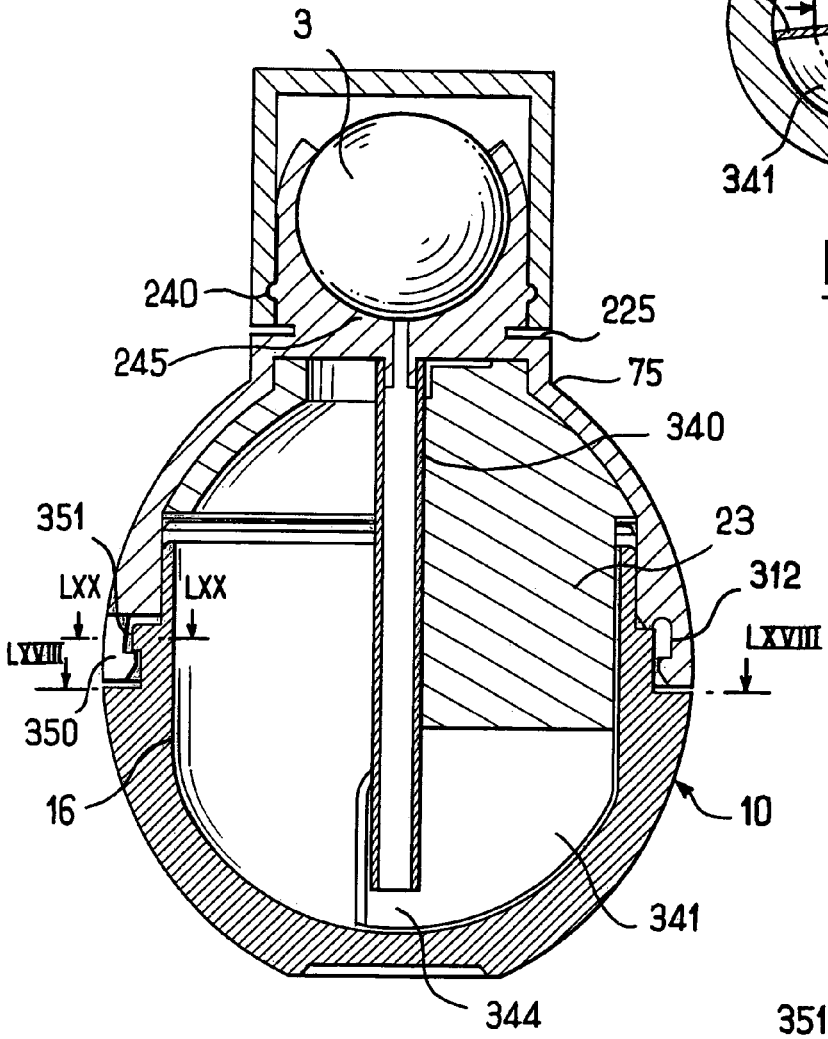
FIG. 67 may be a view analogous to FIG. 62 showing another exemplary embodiment.
Figure 68:
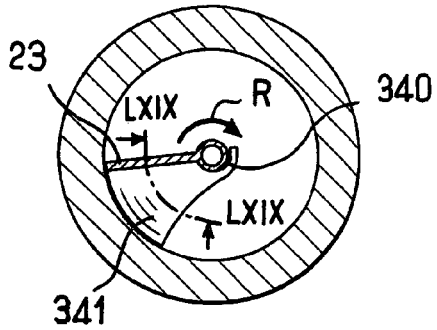
FIG. 68 may be a fragmentary and diagrammatic section view taken along LXVIII-LXVIII of FIG. 67.
Figure 69:
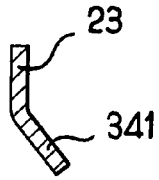
FIG. 69 may be a longitudinal section view taken along LXIX-LXIX of FIG. 68, showing the blade.
Figure 70:
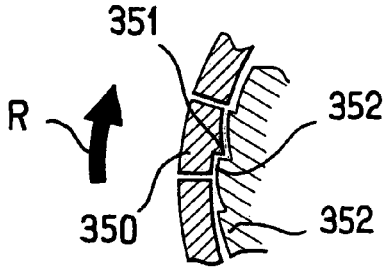
FIG. 70 may be a fragmentary and diagrammatic cross-section view taken along LXX of FIG. 67.

The device shown in FIG. 67 may include a dip tube 340 communicating at the top with an applicator element 3 that comprises a ball, but may be replaced by any other dispensing means, for example, an optionally flocked endpiece, a foam, a felt, and the like.

For example, the second part 20 may include a blade 23 with a bottom portion 341 that may be curved simultaneously downward, inward, and rearward, given the direction of rotation of the blade 23 as represented by the arrow, such that turning the blade 23 may expel the substance toward a central region 344 into which the bottom of the dip tube 340 opens.

To ensure that the parts turn relative to each other in a determined direction R, an elastically deformable tab 350 carrying a pawl 351 may be made with the second part 20, for example, the pawl 351 pressing against ratchets 352 configured in such a manner as to prevent turning in the opposite direction.

In the exemplary embodiment described, the ratchets 352 may be made so as to extend in the annular groove 312 of the second part.

Figure 71:
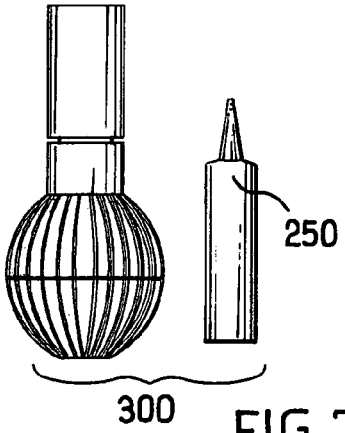
FIG. 71 may be a diagram of a kit according to an exemplary embodiment.

As shown in FIG. 71, any appropriate device, such as the exemplary embodiments described above, may be accompanied in a kit 300 by a tube 250 or other receptacle containing at least one additional component, for example, a solvent, for example, for adding at the time the substance contained inside the device may be used.

Turning the first part 10 relative to the second part 20 may then make it possible to mix the substance with the component inserted in this way and to make the mixture uniform.

This may make it possible, for example, to add an oil to a lipstick that was poured in while hot when filling the device.

It would not go beyond ambit of the present invention for the blade 23 and/or the partition 16 to be of some other shape. For example, the thickness of the blade 23 and/or of the partition 16 may be different. For example, the blade 23 and/or the partition 16 may have a cross-section of shape that may be generally triangular, rectangular, or otherwise.

Nor would it go beyond the ambit of the present invention for the applicator element to have some other shape. For example, the applicator element may in the form of a paintbrush, a comb, or some other form.

For example, FIGS. 72 to 76 show other examples of applicator elements.

Figure 72:
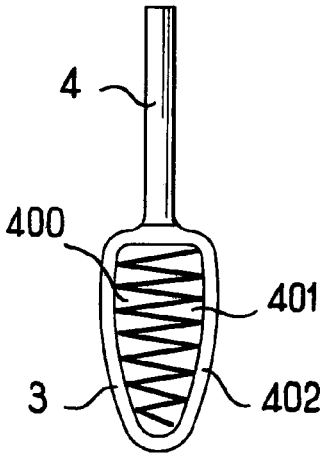
FIGS. 72 to 76 are fragmentary and diagrammatic elevation views of other exemplary embodiments of applicator elements.
Figure 73:
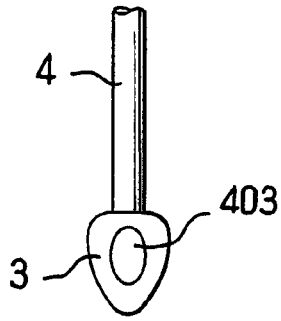

For example, the applicator element may be hollow, as in the examples of FIGS. 72 and 73.

FIG. 72 shows a comb for the eyelashes or the eyebrows which may comprise, for example, two series of teeth 400, 401 that are inter-engaged and that have their bases connected to a frame 402.

The applicator element 3 of FIG. 72 may be made, for example, in accordance with U.S. Patent Application No. 2002/0005209, the entire disclosure of which is incorporated herein by reference.

In FIG. 73, the applicator element 3 may include a central cavity 403. This cavity may become filled with substance when the first and second parts of the receptacle are turned relative to each other.

Figure 74:
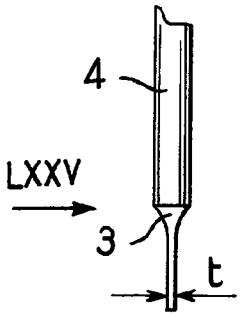
Figure 75:
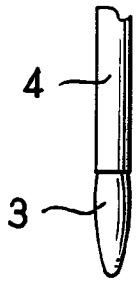

As shown in FIGS. 74 and 75, the applicator element 3 may be generally flat in shape, having a thickness t that may be less than the diameter of the stem 4, for example, so that the substance may remain on each of the main faces of the applicator element 3 after being withdrawn and passed through a wiper member.

Figure 76:
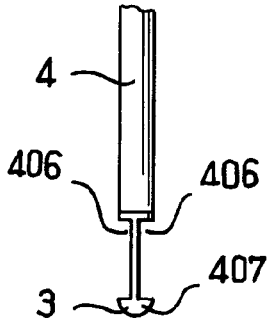

The applicator element 3 shown in FIG. 76 may not have a through cavity, but may have at least one cavity 406 in one of its main faces. Specifically, the applicator element 3 may have two opposite cavities 406. The applicator element 3 may include an enlarged distal end 407 of maximum transverse dimension that corresponds substantially to the diameter of the stem 4, for example. Substance may accumulate in each of the cavities 406, even when the applicator element 3 passes through a wiper member of diameter that substantially matches the diameter of the stem 4.

Figure 78:
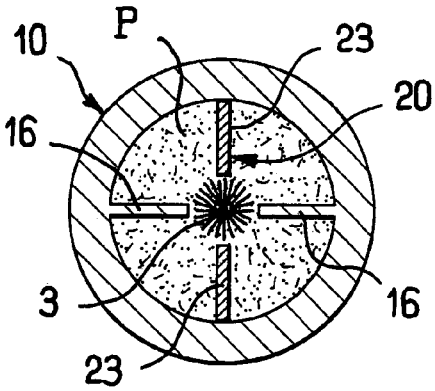
FIG. 78 may be a cross-section view analogous to FIG. 4.

One of the parts 10 and 20 may include a plurality of blades 23, for example, two diametrically opposite blades 23, as shown in FIG. 78, while the other part may include a plurality of partitions 16, for example, two diametrically opposite partitions 16. The shapes of the blades and the partitions may be arbitrary, for example, may have one or more openings and may be planar or otherwise.

Figure 79:
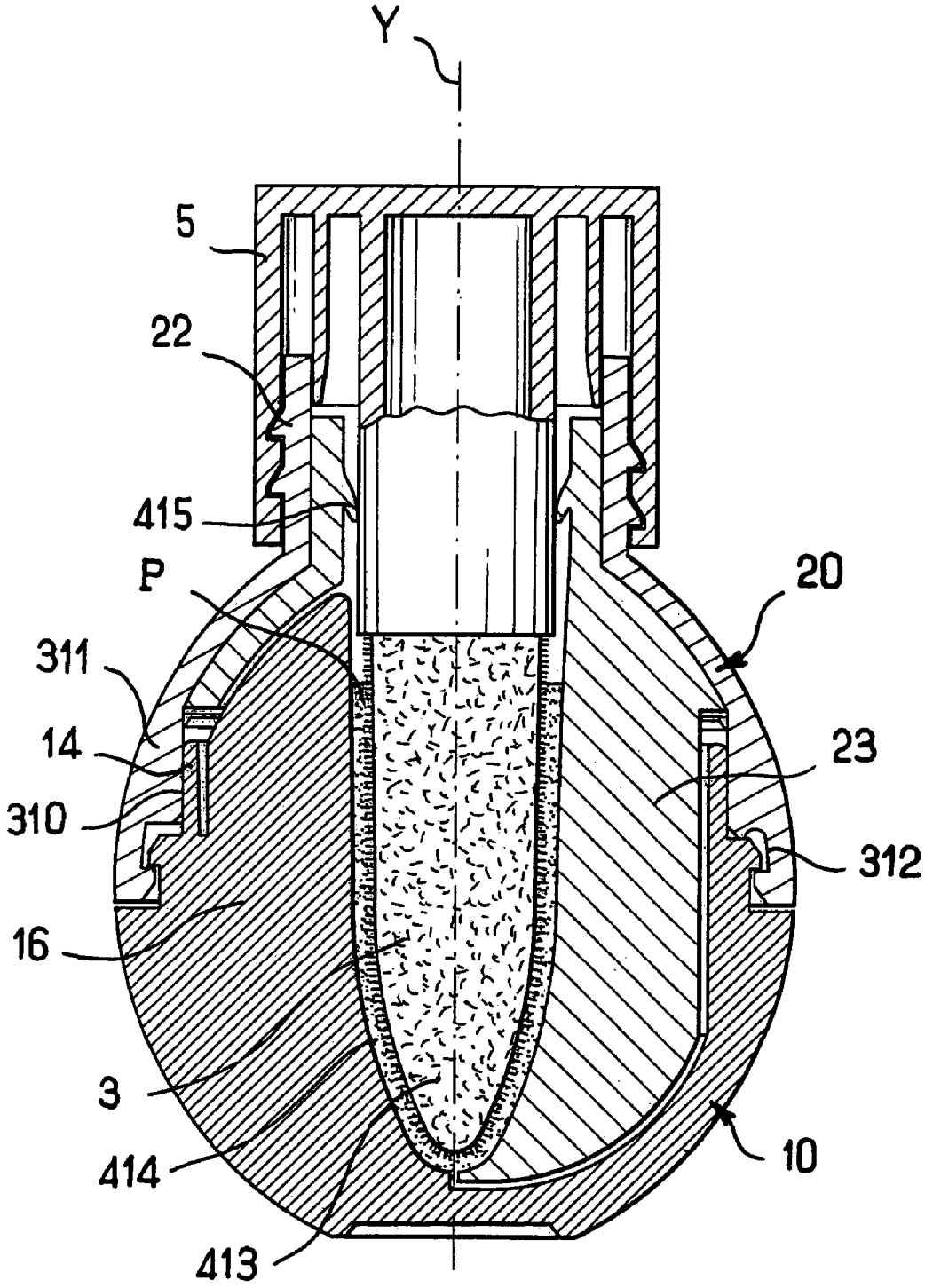
FIG. 79 may be a fragmentary and diagrammatic longitudinal section view of a device according to another exemplary embodiment.

FIG. 79 shows a device that differs from that shown in FIG. 59, for example, by including an applicator element 3 comprising an endpiece for application on the lips or the skin, and optionally coated in flocking 413.

A gap 414 may be left around the applicator element 3 so that after the parts have been turned relative to each other, a film of substance may remain around the applicator element 3. The film may be relatively thick.

The neck may include a wiper lip 415. This lip may be made integrally, i.e., monolithically, with the blade 23, or in exemplary embodiments may comprise a separate fitted piece. The device may contain a plurality of phases of substance that need to be mixed together prior to use.

The wiper lip 415 may also be omitted.

Figure 81:
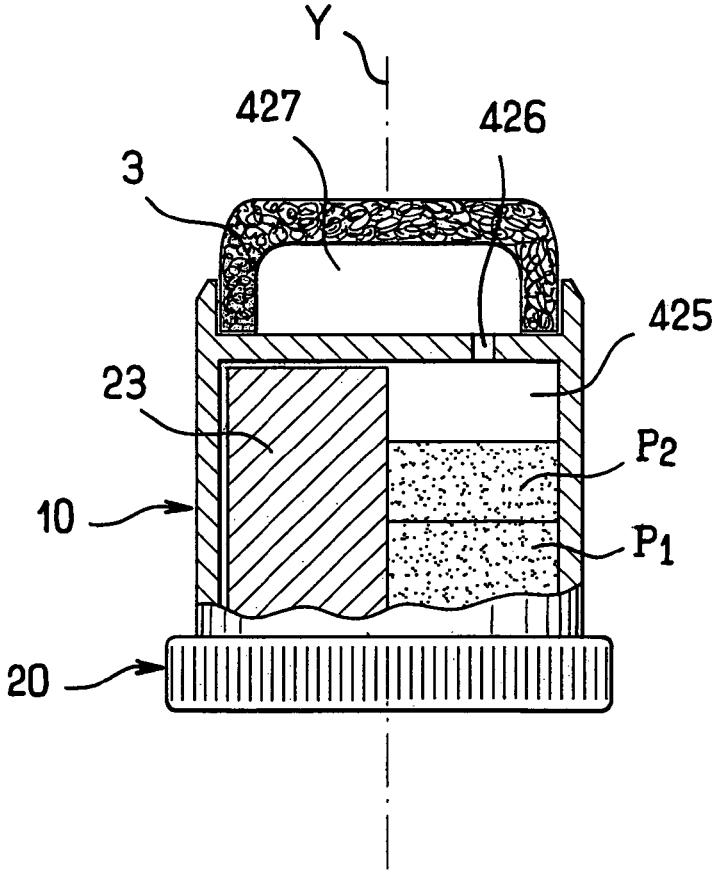
FIG. 81 may be a diagrammatic longitudinal section view showing another exemplary embodiment.

FIG. 81 illustrates that it may be possible for the device to include an inside space 425 provided with an outlet orifice 426 that may be off-center relative to the axis of rotation Y This orifice 426 may open into an inside cavity 427 to feed an applicator element 3, which may comprise, for example, a wall made of a material that may be permeable to the substance.

The inside space 425 may contain, for example, a plurality of phases P1, P2 that need to be blended into a uniform mixture at the moment of utilization by turning the second part 20 relative to the first part 10.

The various phases may be cast in succession while the device may be being filled.

The device of FIG. 81 may include at least one blade 23 and a backing blade (not shown in the drawings), for example, or may include only one blade which on being turned may serve to make the content of the device uniform, and where appropriate or desired, may also serve to encourage the substance to pass through the orifice 426, or force the substance therethrough.

Figure 82:
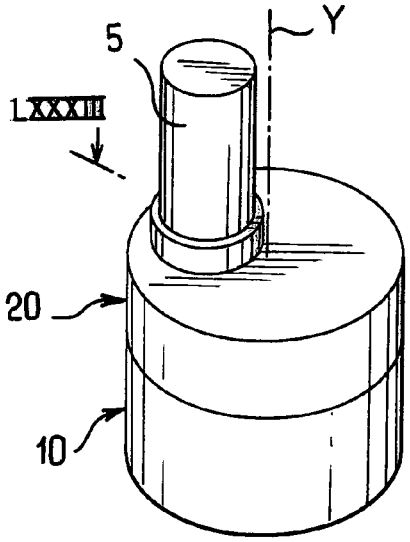
FIG. 82 may be a diagrammatic perspective view of a device according to another exemplary embodiment.
Figure 83:
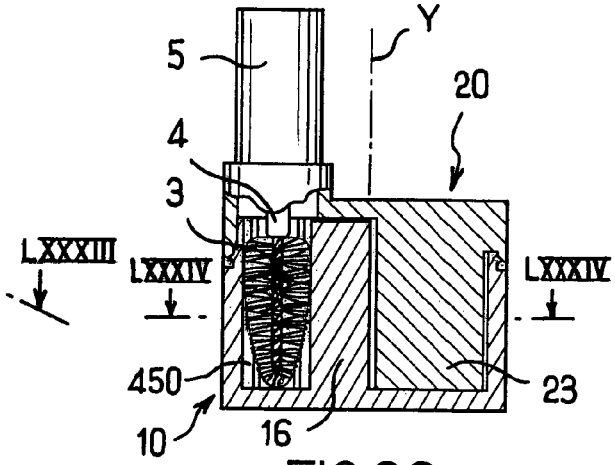
FIG. 83 may be a longitudinal section view taken along LXXXII-LXXXII of FIG. 82.
Figure 84:
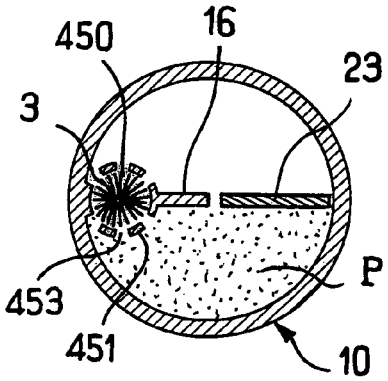
FIG. 84 may be a diagrammatic cross-section view taken along LXXXIV-LXXXIV of FIG. 83.

FIGS. 82 to 84 show another exemplary embodiment of a device according to the invention.

In this device, the applicator may be off-center relative to the axis of rotation Y The applicator may include an applicator element 3, for example, a brush as in the exemplary embodiment shown, which may be received in an off-center housing 450. For example, the housing may have a perforated wall 451 so as to allow the substance P to pass therethrough when the blade 23 driven by the second part 20 turns inside the device.

For example, the wall 451 may have a series of longitudinal slots 453.

Figure 85:
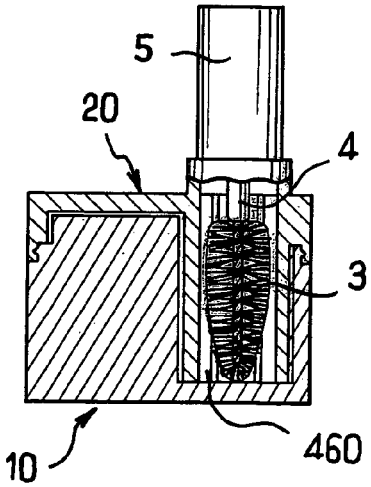
FIG. 85 may be a view analogous to FIG. 83 showing another exemplary embodiment.
Figure 86:
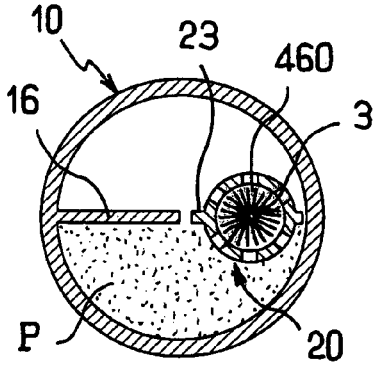
FIG. 86 may be a section view analogous to FIG. 84 showing another exemplary embodiment similar to that of FIG. 85.

The housing 450 may also be made differently and the wall 451 may have different perforations. In the exemplary embodiment shown in FIG. 85, the housing 460 receiving the applicator element 3 may be made integrally, i.e., monolithically, with the blade 23 and may turn together therewith relative to the first part 10.

Figure 87:
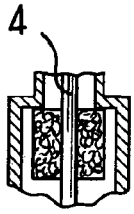
FIG. 87 may be a fragmentary longitudinal section view showing another exemplary embodiment of the wiper member.

If so desired, and in any of the devices, the wiper member may be made using a porous material that may be elastically deformable, such as a block of open-celled foam, as shown in FIG. 87.

The characteristics of the various exemplary embodiments of the invention may be combined with one another in other embodiment that are not shown.

All types of material may be used for making the various portions of the device, for example, the first and second parts and the cap. For example, portions of the device may be made of glass, metal, wood, plastic materials, singly or in combination, so as to obtain a desired or required conservation of the substance.

The substances contained in the device may be care substances, makeup, dermatological substances, or hair care substances, for example.

Exemplary embodiments of the invention make it possible to mix substances that are not miscible or that are traditionally not used in such applications because they comprise two or three phases to be mixed together.

The device may enable the mixture to be made uniform by turning the first and second parts relative to each other. Thus, new substances may be used, for example, for makeup, providing new makeup effects, or better staying power, or other properties that are new or improved.

A substance that may be pasty or even solid may be cast while hot or cold into the device during initial filling, for example, and then some other substance may be added, as mentioned above, such as a liquid, for example, a silicone gum, a silicone oil, or polybutylene, with the substances being mixed together by the device to deliver a final substance that may be uniform.

A plurality of ingredients that are unstable and/or incompatible may be introduced while hot or cold into the device during its initial filling or subsequently, thus making it possible to obtain substances delivered by the device that have rheology or other properties that are difficult to obtain otherwise.

The substance contained in the device may be heated prior to use, for example, in a microwave oven, to improve the behavior of the substance, for example. Moving the two parts of the receptacle relative to each other may make it possible to achieve a uniform temperature prior to application.

Throughout the description, including in the claims, the term "comprising a" should be understood as being synonymous with "comprising at least one" unless specified to the contrary.

What is claimed is:

1. A device for packaging and applying a substance, the device comprising:

a receptacle for containing the substance, the receptacle comprising:

a first part and a second part, the second part being turnable by a user relative to the first part; and an applicator;

the second part defining at least one surface in contact with the substance inside the receptacle, the applicator and said surface being configured so that turning the at least one surface causes the at least one surface to exert pressure on the substance, causing the substance to move toward the applicator, a partition of the first part projecting into an inside space of the receptacle containing the substance and defining a backing surface, and the at least one surface being configured to come at least in part to face said backing surface at an end of turning of the second part, wherein the second part co-operates with the first part to define at least two chambers inside the receptacle, and wherein turning the second part relative to the first part causes a volume of one of the chambers to vary in one direction and a volume of the other one of the chambers to vary in an opposite direction.

2. A device according to claim 1, wherein the first and second parts co-operate by snap-fastening.

3. A device according to claim 1, wherein the first part defines an inside space containing the substance.

4. A device according to claim 1, wherein the first and second parts together define an inside space containing the substance.

5. A device according to claim 3, wherein said surface extends substantially to a wall of the first part defining the inside space.

6. A device according to claim 1, wherein the first part includes a bottom wall with a first portion in relief, and wherein the second part includes a second portion in relief co-operating with the first portion in relief in such a manner as to guide the second part in pivoting relative to the first part.

7. A device according to claim 6, wherein the first portion in relief comprises an indentation and the second portion in relief comprises a stud engaged in the indentation.

8. A device according to claim 6, wherein the second portion in relief comprises an indentation and the first portion in relief comprises a stud engaged in the indentation.

9. A device according to claim 6, wherein the second part includes a blade.

10. A device according to claim 9, wherein the blade is made monolithically with the second portion.

11. A device according to claim 9, wherein the blade includes at least one portion that is fitted to the second part.

12. A device according to claim 11, wherein the at least one portion is made of a material that is different from a material from which a remainder of the second part is made.

13. A device according to claim 9, wherein the blade is pierced by at least one opening.

14. A device according to claim 13, wherein the blade is pierced by a plurality of openings.

15. A device according to claim 1, wherein the second part includes an outer skirt turnable by the user relative to the first part.

16. A device according to claim 1, wherein the second part includes a neck.

17. A device according to claim 16, wherein the neck is threaded.

18. A device according to claim 1, wherein said surface extends at least in part parallel to an axis of rotation of the second part.

19. A device according to claim 1, wherein said surface extends at least in part along a radial plane.

20. A device according to claim 1, wherein said surface has a skew shape so as to cause substance that tends to accumulate at a bottom of the receptacle to rise.

21. A device according to claim 1, wherein said surface includes a bottom edge that matches substantially a shape of a bottom wall of the receptacle.

22. A device according to claim 1, wherein said surface includes a radially outer edge that matches substantially a shape of a side wall of the receptacle.

23. A device according to claim 1, wherein said surface includes a radially inner edge that matches substantially a profile of the applicator.

24. A device according to claim 1, further comprising a dip tube.

25. A device according to claim 1, wherein the backing surface extends substantially radially.

26. A device according to claim 1, wherein said surface includes a radially inner edge that is curved downward and inward.

27. A device according to claim 1, wherein the first part includes an outer covering.

28. A device according to claim 1, wherein the second part includes a perforated central chimney.

29. A device according to claim 1, wherein the first part includes a perforated central chimney.

30. A device according to claim 1, wherein the second part is made as a single piece out of a plastics material.

31. A device according to claim 1, wherein the second part comprises a plurality of component elements made separately and subsequently assembled together.

32. A device according to claim 31, wherein the second part comprises an outer portion and an inner portion secured to the outer portion, the inner portion being capable of turning relative to the first part without moving axially relative to an axis of rotation of the second part.

33. A device according to claim 32, wherein the inner portion includes an annular sealing lip pressing against the first part.

34. A device according to claim 32, wherein the outer portion carries a wiper member.

35. A device according to claim 32, wherein the inner portion carries a wiper member.

36. A device according to claim 35, wherein the wiper member is made monolithically with the inner portion.

37. A device according to claim 35, wherein the inner portion and the wiper member are made out of different materials.

38. A device according to claim 1, wherein the first and second parts are made of different materials.

39. A device according to claim 1, wherein one of the parts forms a neck and includes a sealing means.

40. A device according to claim 1, wherein a ratio $h_e/d$ of a height $h_e$ of the receptacle divided by a greatest transverse dimension d of the receptacle lies in a range of about 0.1 to about 10.

41. A device according to claim 1, wherein the substance is contained in an inside space of the receptacle and wherein a ratio $h_i/d$ of a height $h_i$ of said inside space divided by a greatest transverse dimension d of the receptacle lies in a range of about 0.1 to about 10.

42. A device according to claim 1, wherein the applicator is removable.

43. A device according to claim 42, wherein the applicator includes a stem that is telescopic.

44. A device according to claim 1, wherein the applicator is secured to a closure cap.

45. A device according to claim 44, wherein the applicator extends inside the receptacle when the closure cap is in place on the receptacle.

46. A device according to claim 45, wherein the applicator includes a stem extending substantially parallel to an axis of rotation of the second part.

47. A device according to claim 46, wherein the stem includes a narrow portion that is positioned in registration with a wiper member when in a storage configuration.

48. A device according to claim 47, wherein the wiper member is made out of at least one of polyethylene, polypropylene, polyacetyl, polyethylene terephthalate, sytrene acrylonitrile copolymer, polystyrene, acrylonitrile-butadiene-sytrene copolymer, nitrile, silicone, ethylene polypropylene diene, sytrene-isoprene-sytrene, sytrene ethylene polypropylene butadiene-sytrene, thermoplastic polyester elastomer, thermoplastic elastomer, polyurethane foam, polyester foam, and polyether foam.

49. A device according to claim 46, wherein the stem is made out of at least one of polyethylene, polypropylene, polyamide, polyacetyl, polyethylene terephthalate, sytrene acrylonitrile copolymer, polystyrene and acrylonitrile-butadiene-sytrene copolymer.

50. A device according to claim 45, wherein the applicator includes a stem that extends substantially perpendicularly to an axis of rotation of the second part.

51. A device according to claim 1, wherein the applicator is housed inside the receptacle in a space about which said surface turns.

52. A device according to claim 1, wherein the applicator includes a brush.

53. A device according to claim 1, wherein the applicator comprises an applicator element which extends along a longitudinal axis that makes an angle with a longitudinal axis of a stem that carries the applicator element.

54. A device according to claim 1, wherein the applicator comprises an applicator element that includes at least one cavity suitable for retaining the substance.

55. A device according to claim 1, wherein the applicator comprises an applicator element that is not a brush.

56. A device according to claim 55, wherein the applicator is configured to apply a substance to skin.

57. A device according to claim 56, wherein the applicator comprises a flocked foam.

58. A device according to claim 55, wherein the applicator element comprises at least one of a comb, a felt, a flocked element and a foam.

59. A device according to claim 1, wherein a storage position of the applicator does not extend inside an inside space of the receptacle filled with substance.

60. A device according to claim 59, further comprising a permeable wall between the applicator and the inside space of the receptacle containing the substance.

61. A device according to claim 1, wherein the applicator is secured to the second part at least during use.

62. A device according to claim 61, wherein the second part includes an internal duct arranged to feed the applicator with substance.

63. A device according to claim 1, further comprising a mirror.

64. A device according to claim 1, wherein the receptacle contains a fluid substance, the fluid substance being one of creamy, gelled and pasty consistency.

65. A device according to claim 1, wherein the second part is made out of at least one of polyethylene, polypropylene, polyamide, polyacetyl, polyethylene terephthalate, sytrene acrylonitrile copolymer, polystyrene and acrylonitrile-butadiene-sytrene copolymer.

66. A device according to claim 1, wherein the first part is made out of at least one of polyethylene, polypropylene, polyamide, polyacetyl, polyethylene terephthalate, sytrene acrylonitrile copolymer, polystyrene and acrylonitrile-butadiene-sytrene copolymer.

67. A device according to claim 66, wherein the first part and the second part are made out of different materials.

68. A device according to claim 1, wherein the substance is selected from the following: mascara, eye shadow, lipstick, eye liner, a care product, a foundation, a dermatological product, a hair-care product, a self-tanning product, a lip-care product, an anti-acne product, an after-sun product, a concealer of spots under the eyes, a concealer of wrinkles under the eyes, a deodorant and a care product for application around the eyes.

69. A device according to claim 1, wherein the applicator is situated at a center of the receptacle, and wherein said surface is configured in such a manner that on being turned the surface moves the substance toward the center of the receptacle.

70. A device according claim 1, wherein the applicator is disposed substantially on a path of the substance traveling from the chamber of decreasing volume toward the chamber of increasing volume.

71. A device according to claim 1, further comprising a handle member with a longitudinal axis substantially perpendicular to an axis of rotation of the second part.

72. A device according to claim 1, wherein the first and second parts define a chamber of variable volume, and wherein turning the second part causes the variable volume of said chamber to decrease and substance to be delivered toward the applicator.

73. A device according to claim 72, wherein the substance is dispensed in a direction substantially parallel to an axis of rotation of the second part.

74. A device according to claim 1, wherein the first and second parts are assembled together in a leaktight manner.

75. A device according to claim 1, further comprising a closure cap for the receptacle.

76. A device according to claim 75, further comprising a system that locks the closure cap against rotation relative to one of the first and second parts.

77. A device according to claim 1, wherein the applicator comprises a grid that is flocked, at least in part.

78. A device according to claim 1, wherein the substance comprises at least two immiscible phases, the substance being capable of being made uniform by turning the second part relative to the first part.

79. A device according to claim 1, wherein the substance is one of solid and semi-solid at ambient temperature.

80. A device according to claim 1, wherein the second part comprises at least two blades.

81. A device according to claim 1, wherein the applicator is off-center relative to an axis of rotation of the second part relative to the first part.

82. A device according to claim 81, wherein the applicator is swept through the substance when one of the first and second parts turns relative to the other one of the first and second parts.

83. A kit comprising a device as defined in claim 1, together with a second receptacle containing at least one additional compound for adding to the substance contained in the device.

84. A device for packaging and applying a substance, the device comprising:

a receptacle for containing the substance, the receptacle comprising:

a first part presenting a first circumferential external surface on an outside of the receptacle and a first internal surface opposite the first external surface from which a stationary backing surface projects inside the receptacle toward a central axis of the receptacle; and a second part presenting a second circumferential external surface on the outside of the receptacle and a second internal surface opposite the second external surface from which a contact surface projects within the receptacle toward the central axis, the second part being turnable by a user relative to the first part; and an applicator;

wherein rotation of the second part relative to the first part causes the contact surface to exert pressure on the substance, thereby causing the substance to move toward the applicator when the applicator is within the receptacle, and wherein the contact surface is configured to come, at least in part, to face the stationary backing surface at an end of rotation of the second part.

85. A device for packaging and applying a substance, the device comprising:

a receptacle for containing the substance, the receptacle comprising:

a first part and a second part, the second part being turnable by a user relative to the first part; and an applicator;

the second part defining at least one surface in contact with the substance inside the receptacle, the applicator and said surface being configured so that turning the at least one surface causes the at least one surface to exert pressure on the substance, causing the substance to move toward the applicator, a partition of the first part projecting into an inside space of the receptacle containing the substance and defining a backing surface, and the at least one surface being configured to come to overlie said backing surface at an end of turning of the second part.

86. A device for packaging and applying a substance, the device comprising:

a receptacle for containing the substance, the receptacle comprising:

a first part and a second part, the second part being turnable by a user relative to the first part; and an applicator;

the second part including a blade, first and second main faces of said blade defining first and second rotary surfaces, respectively, said first rotary surface being in contact with the substance inside the receptacle, the applicator and said first rotary surface being configured so that turning the first rotary surface causes the first rotary surface to exert pressure on the substance, causing the substance to move toward the applicator, a partition of the first part projecting into an inside space of the receptacle containing the substance, and defining first and second backing surfaces, the first rotary surface being configured to overlie said first backing surface at an end of turning of the second part in a first direction, and the second rotary surface being configured to overlie said second backing surface at an end of turning of the second part in a second direction opposite to said first direction.

87. A device for packaging and applying a substance, the device comprising:

a receptacle for containing the substance, the receptacle comprising:

a first part and a second part, the second part being turnable by a user relative to the first part; and an applicator;

the first part comprising a pot and the second part including a blade and an outside skirt;

the blade of the second part defining at least one surface in contact with the substance inside the receptacle, the applicator and said surface being configured so that turning the at least one surface causes the at least one surface to exert pressure on the substance, causing the substance to move toward the applicator, a partition of the first part projecting into an inside space of the receptacle containing the substance and defining a backing surface, and the at least one surface being configured to come at least in part to face said backing surface at an end of turning of the second part, wherein at least one of said partition and blade is made integrally with said pot and said skirt, respectively.

88. A device according to claim 87, wherein said partition is made integrally with said pot and said blade is made integrally with said skirt.

89. A device according to claim 88, wherein said skirt defines the upper outside surface of said receptacle.

90. A device according to claim 87, wherein said pot is engaged inside an outer covering.

* * * * *